US011602662B2

(12) United States Patent
Horvath

(10) Patent No.: US 11,602,662 B2
(45) Date of Patent: Mar. 14, 2023

(54) MULTIFUNCTIONAL FITNESS SYSTEM FOR ROTATIONAL EXERCISE

(71) Applicant: GYROTONIC SALES CORP, Miami Beach, FL (US)

(72) Inventor: Julius Horvath, Miami Beach, FL (US)

(73) Assignee: GYROTONIC SALES CORP, Miami Beach, FL (US)

( * ) Notice: Subject to any disclaimer, the term of this patent is extended or adjusted under 35 U.S.C. 154(b) by 247 days.

(21) Appl. No.: 16/916,258

(22) Filed: Jun. 30, 2020

(65) Prior Publication Data

US 2021/0402245 A1 Dec. 30, 2021

(51) Int. Cl.

| | |
|---|---|
| ***A63B 21/00*** | (2006.01) |
| ***A63B 21/062*** | (2006.01) |
| ***A63B 21/16*** | (2006.01) |

(52) U.S. Cl.

CPC ..... *A63B 21/154* (2013.01); *A63B 21/0626* (2015.10); *A63B 21/169* (2015.10); *A63B 21/4035* (2015.10); *A63B 2225/093* (2013.01)

(58) Field of Classification Search

CPC ..... A63B 21/00058; A63B 21/00061; A63B 21/00065; A63B 21/00076; A63B 21/06; A63B 21/062; A63B 21/0624; A63B 21/0626; A63B 21/15; A63B 21/151; A63B 21/154; A63B 21/156; A63B 21/159; A63B 21/169; A63B 21/4027; A63B 21/4033; A63B 21/4034; A63B 21/4035; A63B 21/4045; A63B 21/4047; A63B 21/4049; A63B 23/035; A63B 23/04; A63B 23/0405; A63B 23/0482; A63B 23/0494; A63B 23/12; A63B 23/1209; A63B 23/1245; A63B 23/1281; A63B 2210/00; A63B 2210/50; A63B 2225/09; A63B 2225/093; A63B 2225/10; A63B 2225/102

See application file for complete search history.

(56) References Cited

U.S. PATENT DOCUMENTS

| | | | | | |
|---|---|---|---|---|---|
| 4,784,385 | A * | 11/1988 | D'Angelo | A63B 21/00069 | 482/111 |
| 4,850,586 | A | 7/1989 | Horvath | | |
| 5,391,132 | A * | 2/1995 | Greenwald | A63B 21/4047 | 482/114 |
| 5,419,747 | A * | 5/1995 | Piaget | A63B 22/001 | 482/70 |
| RE36,031 | E * | 1/1999 | Piaget | A63B 69/0064 | 482/70 |
| 6,387,023 | B1 * | 5/2002 | Liga, Jr. | A63B 21/4049 | 482/121 |

(Continued)

FOREIGN PATENT DOCUMENTS

| | | | | |
|---|---|---|---|---|
| CA | 2531409 C | * | 9/2012 | A61H 1/0281 |
| CN | 108079490 A | * | 5/2018 | A63B 21/00065 |

*Primary Examiner* — Gary D Urbiel Goldner
(74) *Attorney, Agent, or Firm* — Ladas & Parry LLP

(57) ABSTRACT

An integrated fitness system including a slidable unit that is slidably attached to a column vertical to the ground and that has exercise units mounted thereon. The exercise units are disposable in any of a plurality of configurations and have arms that are rotatable in any of a plurality of planes. The exercise units can be positioned along the column at any of a plurality of heights by sliding the slidable unit along the column to allow a user to use the exercise units for both arm and leg exercises.

19 Claims, 24 Drawing Sheets

(56) References Cited

U.S. PATENT DOCUMENTS

| | | | | |
|---|---|---|---|---|
| 7,635,320 | B2 | 12/2009 | Horvath | |
| 7,833,138 | B1 * | 11/2010 | Fulks | A63B 23/12 482/136 |
| 8,057,368 | B1 | 11/2011 | Lyszczarz | |
| RE43,167 | E * | 2/2012 | Horvath | A63B 21/4045 482/142 |
| 9,669,251 | B2 * | 6/2017 | Jones-Guinasso | A63B 23/0494 |
| 10,220,234 | B2 * | 3/2019 | Marti | A63B 21/4017 |
| 10,426,990 | B2 * | 10/2019 | Hockridge | A63B 21/0628 |
| 10,646,738 | B2 * | 5/2020 | Arturo | A63B 21/156 |
| 10,799,756 | B2 * | 10/2020 | Tuononen | A63B 21/0628 |
| 11,077,337 | B1 * | 8/2021 | Majkrzak | A63B 23/02 |
| 2002/0094918 | A1 * | 7/2002 | Gerschefske | A63B 21/4029 482/92 |
| 2005/0245367 | A1 * | 11/2005 | Horvath | A63B 21/068 482/93 |
| 2007/0054785 | A1 * | 3/2007 | Drechsler | A63B 21/156 482/94 |
| 2007/0161472 | A1 * | 7/2007 | Drechsler | A63B 21/4017 482/99 |
| 2012/0094813 | A1 * | 4/2012 | Berardo | A63B 21/4035 482/139 |
| 2015/0094193 | A1 * | 4/2015 | Lyszczarz | A63B 21/4023 482/99 |
| 2016/0001118 | A1 * | 1/2016 | Kuehne | A63B 23/04 482/54 |
| 2016/0279459 | A1 * | 9/2016 | Walker | A63B 21/4047 |
| 2018/0361200 | A1 * | 12/2018 | Walker | A63B 1/00 |
| 2019/0111312 | A1 * | 4/2019 | Taivainen | A61H 1/0281 |
| 2021/0220691 | A1 * | 7/2021 | Ivanov | A63B 21/0442 |

* cited by examiner

MULTIFUNCTIONAL FITNESS SYSTEM FOR ROTATIONAL EXERCISE

FIELD OF THE INVENTION

The present invention generally relates to a fitness system, and more particularly to an integrated fitness system comprising a slidable unit that is slidably attached to a column vertical to the ground and that has exercise units mounted thereon.

BACKGROUND OF THE INVENTION

There are many types of fitness systems on the market today which enable multiple exercise routines in various positions on a single machine, including machines with rotors that can be oriented in a plurality of different planes for exercising the arms of a user. For example, U.S. Pat. No. 4,850,586 A to Horvath (the contents of which are incorporated herein by reference) describes an exercise device that has rotors that can be oriented in any one of three mutually perpendicular planes for arm exercises.

As another example, U.S. Pat. No. 7,635,320 B2 to Horvath (the contents of which are incorporated herein by reference) describes an exercise device with a pair of arms mounted on opposite sides of a head member so as to be selectively pivotable about a horizontal axis into various positions and selectively pivotable about an axis perpendicular to the horizontal axis into various positions so as to change an angle defined by the arms. This device provides an arm system designed for a wide range of exercises for a user's arms and allows an easy change in the planes of rotation. It also has an integrated bench and a separate leg system for exercise of a user's legs. The arm system and the leg system are separate systems that are disposed on respective top and bottom portions of the device and that require a user to adjust the systems separately for arm and leg exercises.

There are also machines on the market which comprise a central system that is slidable from a top portion to a bottom portion of the machines. In particular, U.S. Pat. No. 8,057,368 B1 to Lyszczarz (the contents of which are incorporated herein by reference) describes an exercise machine having a slidable carriage assembly having means to slide and lock on an upright post along a substantially vertical axis. The carriage assembly provides a single point for adjustment of the height of the carriage assembly and also provides right and left arm assemblies rotatably, adjustably, and independently mounted to the slidable carriage assembly with each arm assembly having an axis of rotation parallel to a forward horizontal axis. The machine is provided with cables that extend through the arm assemblies and connect with a resistance assembly and a pulley assembly to guide the cables and to permit a user to use the arm assemblies for resistance exercises.

The design of the machine described in the Lyszczarz patent, which requires cables for the resistance assembly to extend through the arm assemblies to enable resistance exercises, does not allow for all of the orientations of the arm assemblies that are possible with the devices described in the Horvath patents or for the different possible exercises that are enabled thereby. Moreover, the arm assemblies of the Lyszczarz machine are not easily adjustable for use in leg exercises.

What is needed is an integrated exercise device comprising a pair of assemblies that can be used for both arm and leg exercises, wherein a disposition of the height of the pair of assemblies is adjustable by a single adjustment, wherein each of the pair of assemblies is rotatable and configurable into a maximal number of orientations to permit a large number of arm and leg exercises.

SUMMARY OF THE INVENTION

The following presents a simplified summary in order to provide a basic understanding of some aspects described herein. This summary is not an extensive overview of the claimed subject matter. It is intended to neither identify key or critical elements of the claimed subject matter nor delineate the scope thereof. Its sole purpose is to present some concepts in a simplified form as a prelude to the more detailed description that is presented later.

In accordance with a first embodiment of the invention, there is provided an exercise apparatus, comprising:

(1) a frame for supporting the apparatus, the frame comprising a bottom portion and a top portion;

(2) an elongate column mounted on the frame such that, with the frame disposed on a ground surface, the column extends in a vertical direction from the bottom portion of the frame to the top portion of the frame;

(3) a pair of arm/leg assemblies; and (4) a slidable unit comprising a central hub, means for sliding and securing the central hub along the column at any of a plurality of positions, including a position at the top portion of the frame and a position at a bottom portion of the frame, and means for mounting the pair of arm/leg assemblies on opposite sides of the central hub such that, with the frame disposed on the ground surface, the arm/leg assemblies can be disposed at a plurality of different heights above the ground surface by sliding the hub along the column;

wherein each of the pair of arm/leg assemblies comprises (i) a first arm unit comprising an elongate first arm having a first end and a second end; (ii) a second arm unit comprising an elongate second arm having a first end and a second end and a handle protruding from the second end of the elongate second arm; and (iii) a mounting unit that rotatably mounts the first end of the second arm to the second end of the first arm such that the second arm unit can be fixedly disposed relative to the first arm unit in any of a plurality of configurations and, with use of the handle, rotated 360 degrees with respect to the first arm unit in any of a plurality of planes, including a first plane that is transverse to the vertical direction and a second plane that is parallel to the vertical direction.

In a preferred aspect of this first embodiment, the means for mounting enables each of the pair of arm/leg assemblies to be (i) selectively pivotable about a horizontal axis into various positions and selectively pivotable about an axis perpendicular to the horizontal axis into various other positions so as to enable change of an angle defined by the first arm units relative to each other and (ii) securable in the various positions and various other positions.

In another preferred aspect of this first embodiment, the exercise apparatus comprises a resistance assembly, a plurality of pulley assemblies, at least one cable for coupling the plurality of pulley assemblies to the resistance assembly and gripping means at an end of the at least one cable for enabling a user to grip the at least one cable, the plurality of pulley assemblies comprising a first pulley assembly and a second pulley assembly disposed on a bottom of the elongate column and a bottom of the central hub respectively such that the first pulley assembly can guide the at least one cable to the second pulley assembly such that, by sliding the central hub along the column, the second pulley assembly guides the at least one cable to positions at any of a plurality of heights above the ground surface whereby the user can engage in resistance exercises at any of the plurality of heights with use of the gripping means at the end of the at least one cable.

In another preferred aspect of this first embodiment, the plurality of pulley assemblies further comprises a third pulley assembly disposed on the top portion of the frame.

In yet another preferred aspect of the first embodiment, each of the handles of the pair of arm/leg assemblies comprises means for detaching and re-attaching the handles from the elongate second arms, and wherein the exercise apparatus further comprises a plurality of foot attachments with the plurality of foot attachments comprising means for attaching the foot attachments to respective of the elongate second arms of the arm/leg assemblies when the handles are detached from the elongate second arms. In a further preferred aspect of this embodiment each of the elongate second arms comprises a hollow tubular member and each of the means for detaching and reattaching the handles and each of the means for attaching and detaching the foot attachments comprises a bar configured to slide into and out of the hollow tubular member.

In a still further preferred aspect of the first embodiment, the exercise apparatus comprises means for counterbalancing the slidable unit, wherein the means for counterbalancing is disposed on an opposite side of the frame from the slidable unit.

In another aspect of the first embodiment, the counterbalancing means comprises a second slidable unit that is slidable along a second elongate column disposed on the opposite side of the frame, wherein the at least one cable connects the slidable unit comprising the central hub with the second slidable unit.

In yet another aspect of the first embodiment, the means for sliding and securing the central hub on the column comprises a round plate and a U-shaped plate, wherein the central hub is coupled to a front side of the round plate, and wherein the U-shaped plate is coupled to a rear side of the round plate.

In still another aspect of the first embodiment, the means for sliding and securing the central hub on the column comprises a knob on the U-shaped plate.

In a further aspect of the first embodiment, the exercise apparatus is a standalone structure without an integrated bench.

In a preferred aspect of the first embodiment, the exercise apparatus further comprises: a base that is disposed below the frame and supports the exercise apparatus, a plurality of legs, and securing means for attaching the plurality of legs; wherein the plurality of legs are detachably attached to the base with the securing means and wherein the base stably supports the exercise apparatus both with the plurality of legs attached to the base and with the plurality of legs detached from the base.

In another preferred aspect of the first embodiment, the exercise apparatus comprises a second elongate column that is attachable to a vertical wall or other vertically oriented surface and the slidable unit is detachable from the elongate column and mountable on the second elongate column with the central hub slidable and securable along the second elongate column at any of a plurality of positions whereby a user can attach the sliding unit to either the elongate column or the second elongate column to perform exercises with the sliding unit on either the elongate column or the second elongate column.

In accordance with a second embodiment of the invention, there is provided a slidable unit for sliding on a vertical column, the slidable unit comprising:

(a) a central hub;

(b) a pair of arm/leg assemblies, each of the pair of arm/leg assemblies comprising (i) a first arm unit comprising an elongate first arm having a first end and a second end; (ii) a second arm unit comprising an elongate second arm; and (iii) a mounting unit that rotatably mounts the first end of the second arm to the second end of the first arm such that the second arm unit can be fixedly disposed relative to the first arm unit and rotated 360 degrees with respect to the first arm unit in any of a plurality of planes, including a first plane that is transverse to the vertical direction and a second plane that is parallel to the vertical direction;

(c) means for mounting the pair of arm/leg assemblies on opposite sides of the central hub such that they are (i) selectively pivotable about a horizontal axis into various positions and selectively pivotable about an axis perpendicular to the horizontal axis into various other positions so as to enable change of an angle defined by the first arm units relative to each other and (ii) securable in the various positions and various other positions;

(d) means for sliding the central hub along the vertical column to any of a plurality of positions;

(e) means for securing the central hub to the vertical column at any of the plurality of positions; and (e) a pulley assembly disposed on a bottom of the hub such that the pulley assembly can guide a cable coupled to a resistance assembly to positions at any of a plurality of heights above the ground when the hub is slid and secured along the vertical column at any of the plurality of heights.

In a preferred aspect of the second embodiment, the means for sliding the central hub on the vertical column comprises a U-shaped plate that is slidably attachable to the vertical column and a round plate comprising a plurality of holes, wherein the central hub is mounted to a front side of the round plate, and the U-shaped plate is mounted to a rear side of the round plate, and wherein the round plate comprises means for securing a cable for pulling the slidable unit along the column.

In a still preferred aspect of the second embodiment, each of the handles of the pair of arm/leg assemblies comprises means for detaching and re-attaching the handles from the elongate second arms.

In a further preferred aspect of the second embodiment, there is provided an apparatus comprising the slidable unit and a plurality of foot attachments, the plurality of foot attachments comprising means for attaching the foot attachments to respective of the elongate second arms of the arm/leg assemblies when the handles are detached from the elongate second arms.

In another preferred aspect of the second embodiment, there is provided an apparatus comprising the slidable unit and a column that is mountable on a wall in a vertical disposition with respect to the ground.

BRIEF DESCRIPTION OF THE DRAWINGS

The features and advantages of the present invention will be more readily understood from a detailed description of the exemplary embodiments taken in conjunction with the following figures.

The invention will next be described in connection with certain exemplary embodiments; however, it should be clear to those skilled in the art that various modifications, additions, and subtractions can be made without departing from the spirit or scope of the claims.

DETAILED DESCRIPTION OF THE PREFERRED EMBODIMENTS

The various aspects of the subject innovation are now described with reference to the annexed drawings, wherein like numerals refer to like or corresponding elements throughout. It should be understood, however, that the drawings and detailed description relating thereto are not intended to limit the claimed subject matter to the particular form disclosed. Rather, the intention is to cover all modifications, equivalents and alternatives falling within the spirit and scope of the claimed subject matter.

Figure 1A:
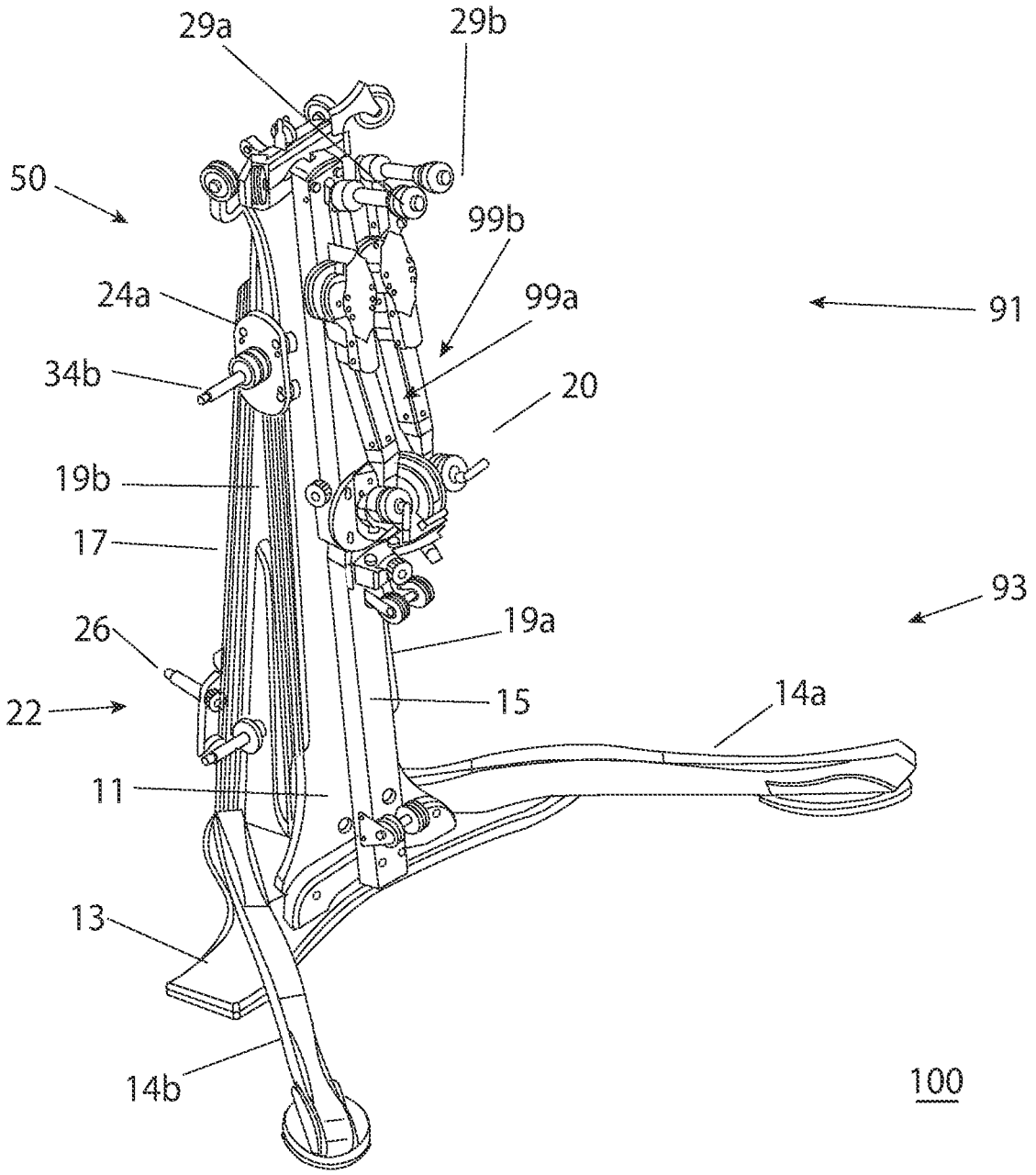
FIG. 1A is a front perspective view of a fitness system according to one embodiment of the present invention.
Figure 1B:
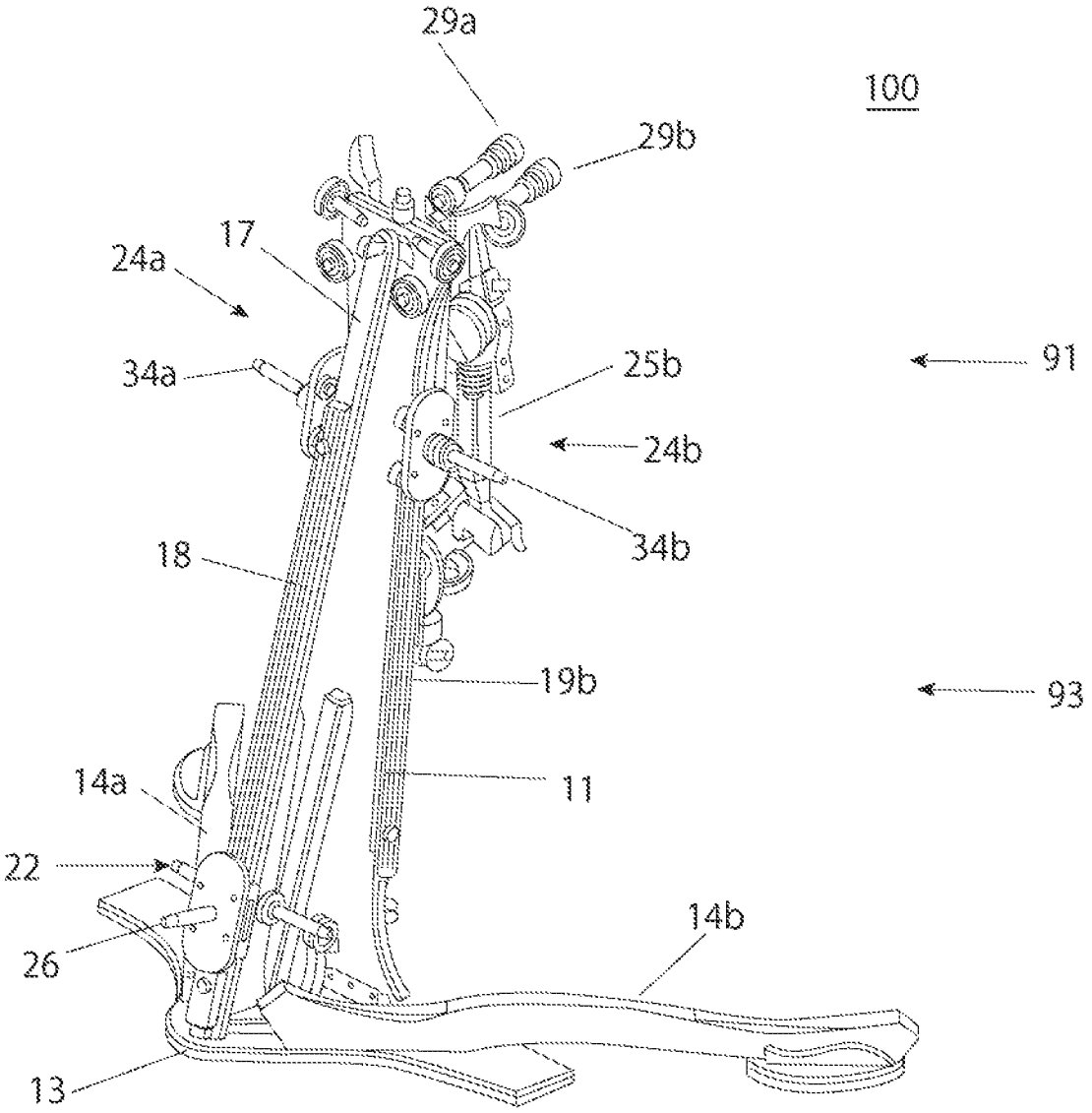
FIG. 1B is a rear perspective view of a fitness system according to one embodiment of the present invention.

Referring to FIGS. 1A-1B, there is shown a fitness system 100 according to a preferred embodiment. The fitness system 100 comprises a frame 50. The frame 50 comprises a bottom portion 93 and atop portion 91. An elongate column 15 is mounted on the frame 50 such that, with the frame 50 disposed on a ground surface, the column 15 extends in a vertical direction from the bottom portion 23 of the frame to the top portion 91 of the frame 50.

In one embodiment, the frame 50 comprises a first vertical support 11, a second vertical support 17 and a base 13. The first vertical support 11 is disposed on the base 13 with a lower end of the first vertical support 11 attached to the base 13. The base 13 has a plurality of legs 14*a, b*. A first column 15 is attached to a front side of the first vertical support 11. The fitness system 100 comprises a first slidable unit 20. The first slidable unit 20 is slidably attached to the first column 15 and is slidable upward or downward along the first column 15.

Figure 7A:
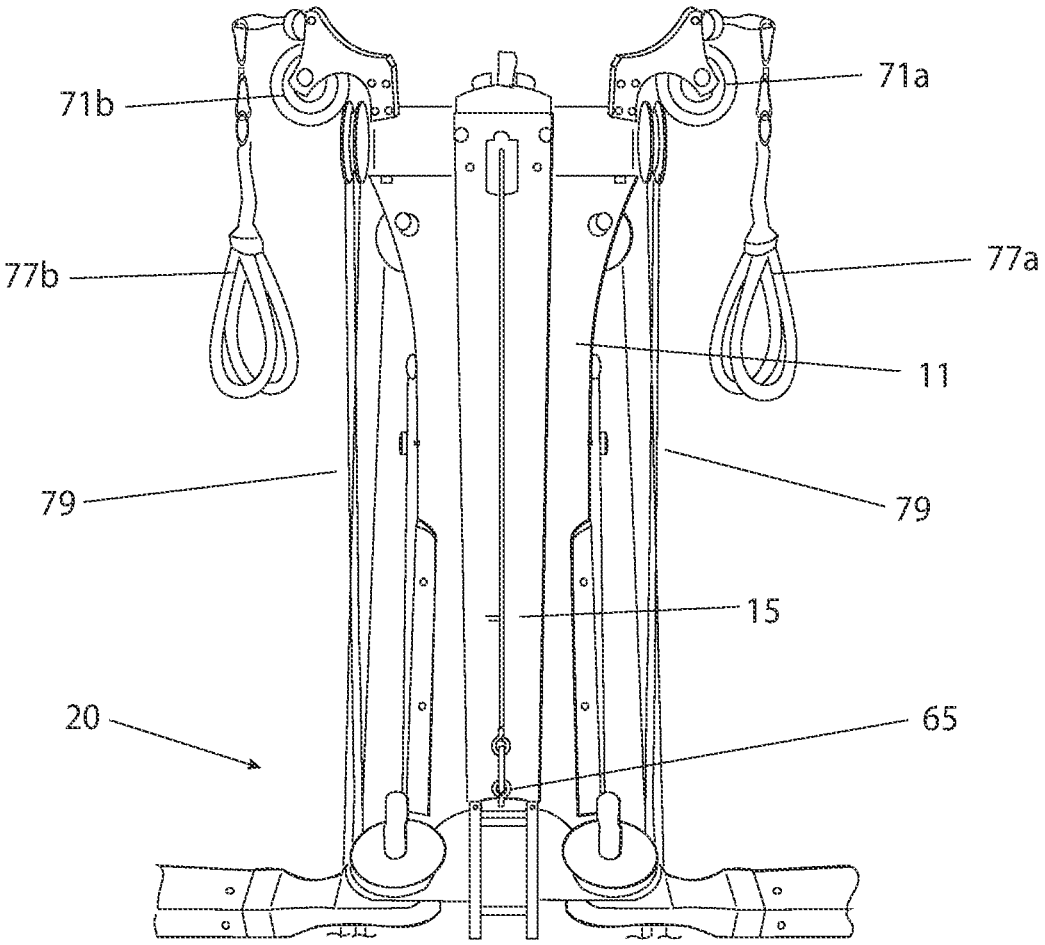
FIG. 7A is a front view of top portion of a fitness system according to one embodiment of the present invention.
Figure 7B:
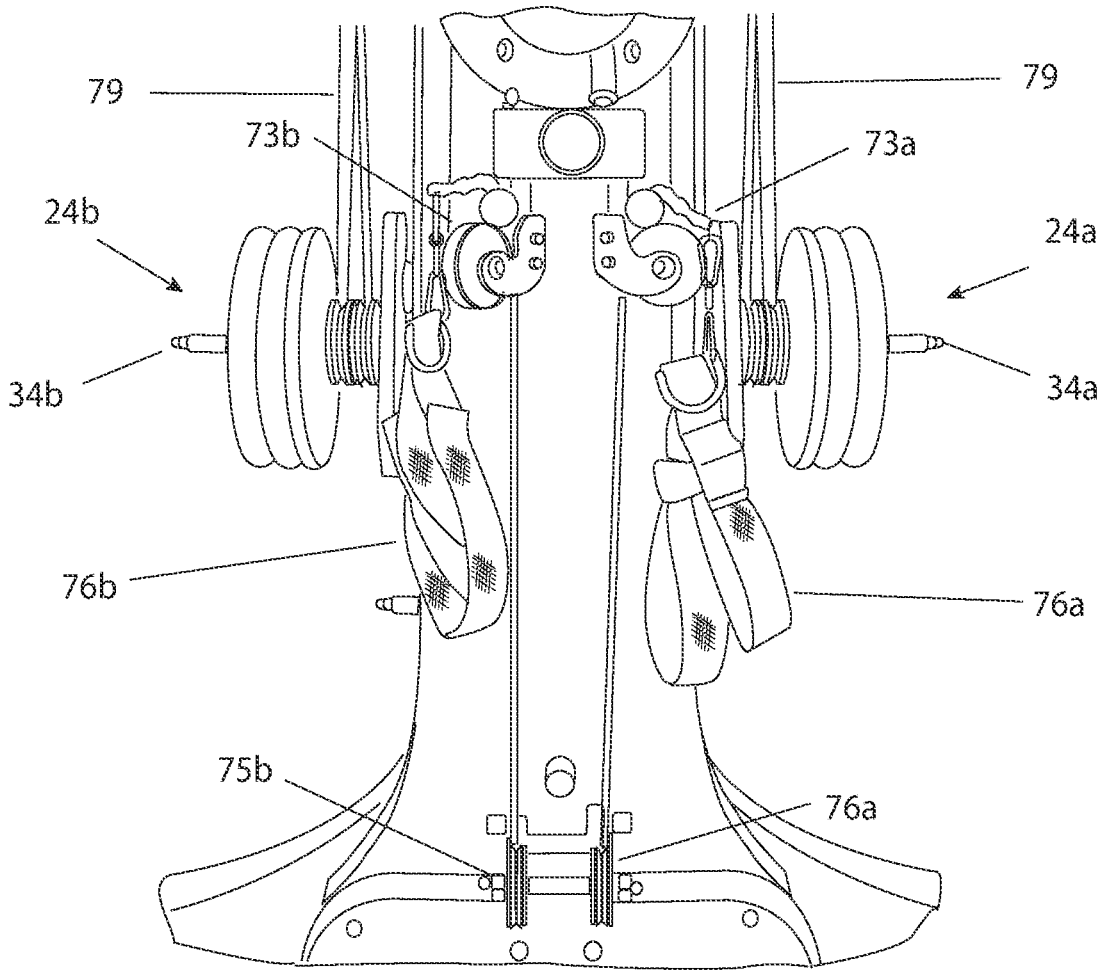
FIG. 7B is a front view of bottom portion of a fitness system according to one embodiment of the present invention.

Still referring to FIGS. 1A-1B, the first slidable unit 20 comprises a central hub 21 and a pair of arm/leg assemblies 99*a, b*. Each of the pair of arm/leg assemblies 99*a, b* comprise: (i) a first arm unit comprising an elongate first arm 25*a, b* having a first end and a second end, (ii) a second arm unit comprising an elongate second arm 27*a, b* having first end and a second end and a handle 29*a, b* protruding from the second end of the elongate second arm 27*a, b*, and (iii) mounting units 23*a, b* for rotatably mounting the first end of the second arm 27*a, b* to the second end of the first arm 25*a, b* such that the second arm unit can be fixedly disposed relative to the first arm unit in any of a plurality of configurations and, with use of the handle 29*a, b*, rotated 360 degrees with respect to the first arm unit in any of a plurality of planes, including a first plane that is transverse to the vertical direction and a second plane that is parallel to the vertical direction. The first slidable unit 20 is connected by a cable 79 to a second slidable unit 22, which slides along a second elongate column 18 attached to second vertical support 17 (see FIGS. 7A-7B.) The second slidable unit 22 counterbalances the first slidable unit 20 for smooth adjustment of the height of the first slidable unit 20. The second slidable unit 22 comprises a projection 26 for adding weights to the second slidable unit 22. A lower end of the second vertical support 17 is attached to the base 13, with the lower end of the second vertical support 17 spaced from the lower end of the first vertical support 11 and an upper end of the second vertical support 17 meeting the first vertical support 11 at a top of the frame 50. The tilt of the second vertical support 17 toward the first vertical support 11 provides for a smooth counterbalancing between first and second slidable units 20, 22.

As shown in FIGS. 1A-1B, third and fourth columns 19*a, b* are attached to the lateral sides of the first vertical support 11. Third and fourth slidable units 24*a, b* are slidably attached to the third and fourth columns 19*a, b*, respectively. Slidable units 24*a, b* are part of a resistance assembly and comprise projections 34*a*, 34*b* to which weights can be separately added (see FIG. 7B). The third and fourth slidable units 24*a, b* are connected to respective pulley handles 76*a, b* (FIG. 7B) through a plurality of pulley assemblies 71*a*, 71*b*, 73*a*, 73*b*, 75*a*, 75*b* and pulley cables 79 (see FIGS. 2, 7A, 7B).

Figure 2:
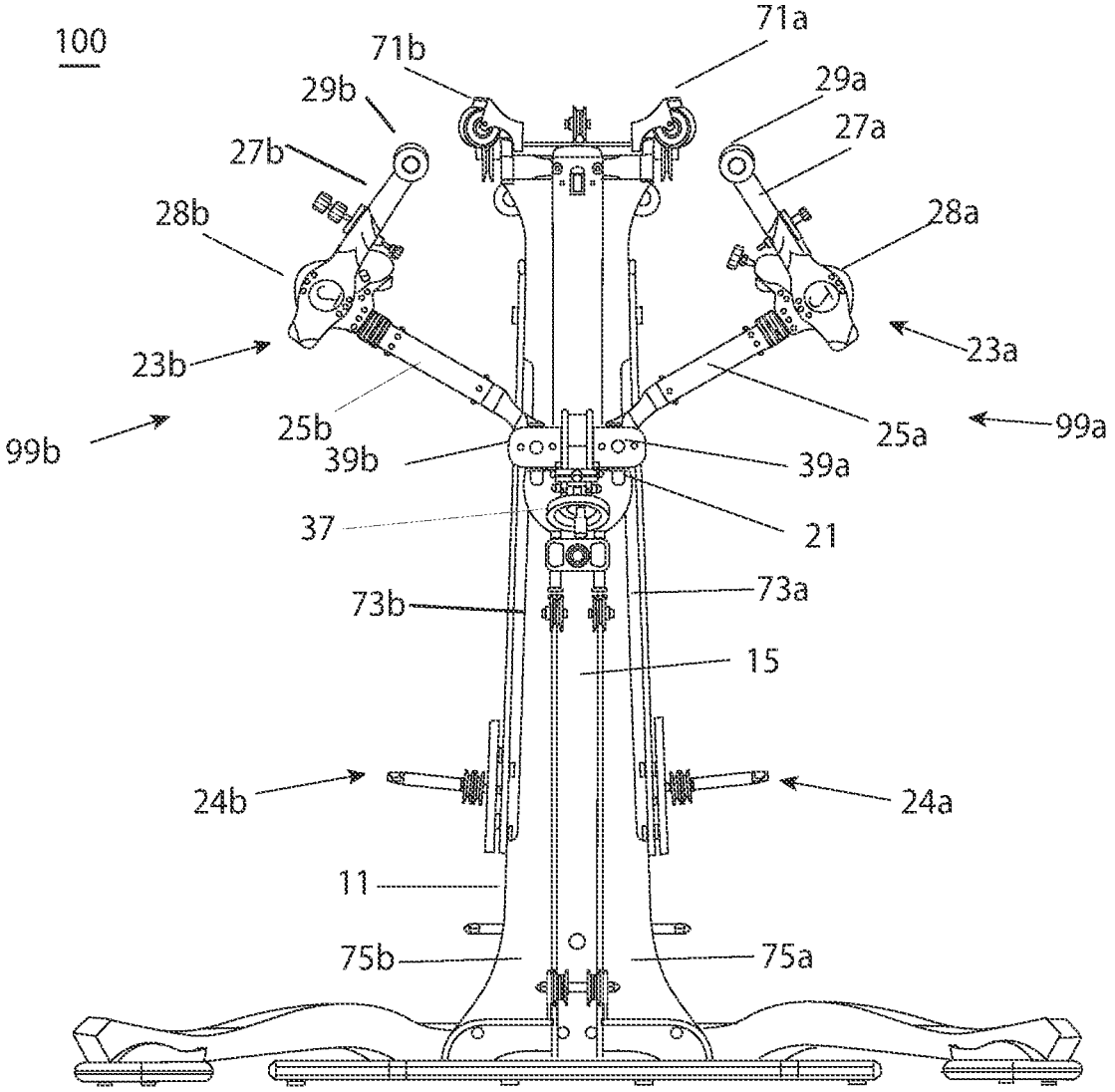
FIG. 2 is a front view of a fitness system according to one embodiment of the present invention with the arm assemblies in a first configuration.

Referring again to FIG. 2, fitness system 100 is shown with the arm/leg assemblies 99*a, b* in a different configuration from that in FIG. 1. The different configurations of the arm/leg assemblies 99*a, b* are enabled by a pair of mounting units 23 *a, b* connecting the pair of first arms 25*a, b* to the pair of second arms 27*a, b* and mounts 39*a, b*, connecting the pair of first arms 25 *a, b* to central hub 21 (see FIG. 3A). As shown in FIG. 2, mounting units 23*a, b* comprise rotors 28*a, b* for rotatably mounting the pair of second arms 27*a, b* relative to the pair of first arms 25*a, b*. The mounts 39*a, b* comprise fasteners 41*a, b* (see FIGS. 3B, 6B) for fixedly disposing the pair of first arms 25*a, b* relative to the central hub 21 in any of a plurality of positions, including a first position wherein a user of fitness system 100 can grasp handles 29*a, b* and rotate the pair of second arms 27*a, b* in a plane that is transverse to the vertical direction (see FIGS. 8, 9), a second position wherein the user can rotate the pair of second arms 27*a, b* in a plane that is parallel to the vertical direction (see FIGS. 2, 11) and a third position wherein the user can rotate the pair of second arms 27*a, b* in an intermediate plane (see FIG. 10). The rotors 28*a, b* can be any rotatable device known in the art.

One of skill in the art will appreciate that, with the pair of second arms 27*a, b* rotatable about the respective rotors 28*a, b* so as to enable a user grasping the handles to rotate the pair of second arms 360 degrees with respect to the pair of first arms 25*a, b*, the user can exercise his or her arms and legs by performing circular movements. As one of skill in the art will also appreciate, the rotors 28*a, b* can be any rotatable devices known in the art, such as those described in U.S. Pat. No. 7,635,320 B2, and are not further explained herein in detail.

The fitness system 100 comprises a resistance assembly, a plurality of pulley assemblies 71*a*, 71*b*, 73*a*, 73*b*, 75*a*, 75*b* and cables 79 for coupling the plurality of pulley assemblies to the resistance assembly. The resistance assembly includes the third and fourth sliding units 34*a, b*. The plurality of pulley assemblies comprises a first pulley assembly 75*a, b* disposed at the bottom portion of the first column 15; a second pulley assembly 73*a, b* disposed at a bottom portion of the central hub 21; and a third pulley assembly 71*a, b* disposed at atop portion of the fitness system 100. The first pulley assembly 75*a, b* guides cables 79 to the second pulley assembly 73*a, b* at the bottom of the central hub whereby, by sliding the central hub 21 on the first column 15, a user can grasp handles 76*a, b* and 77*a, b* at the ends of the cables 79 to engage in resistance exercises at any of a plurality of heights above the ground (see FIGS. 7A-B).

Figure 3A:
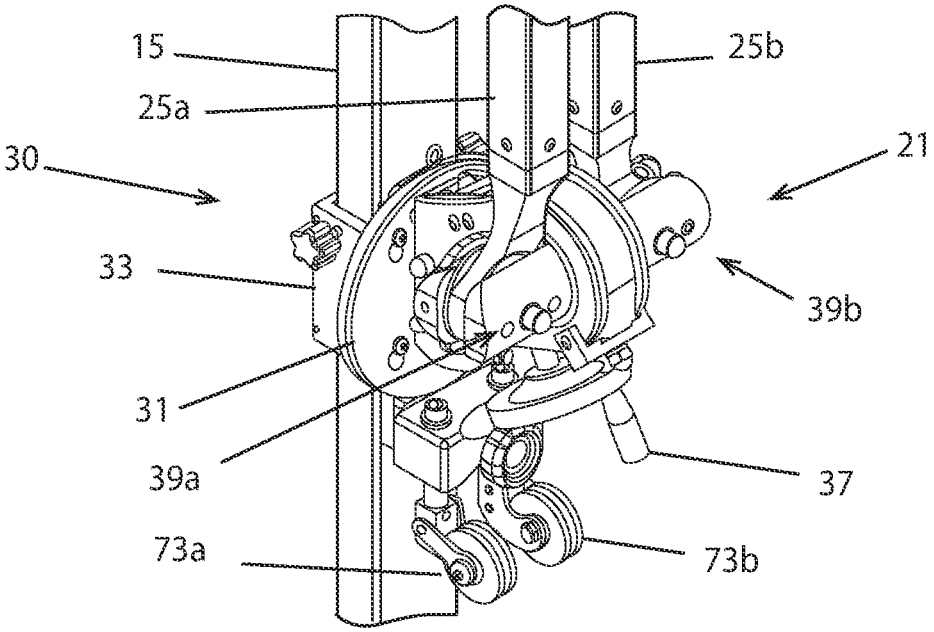
FIG. 3A is s front perspective view of a central hub of a fitness system according to one embodiment of the present invention.
Figure 3B:
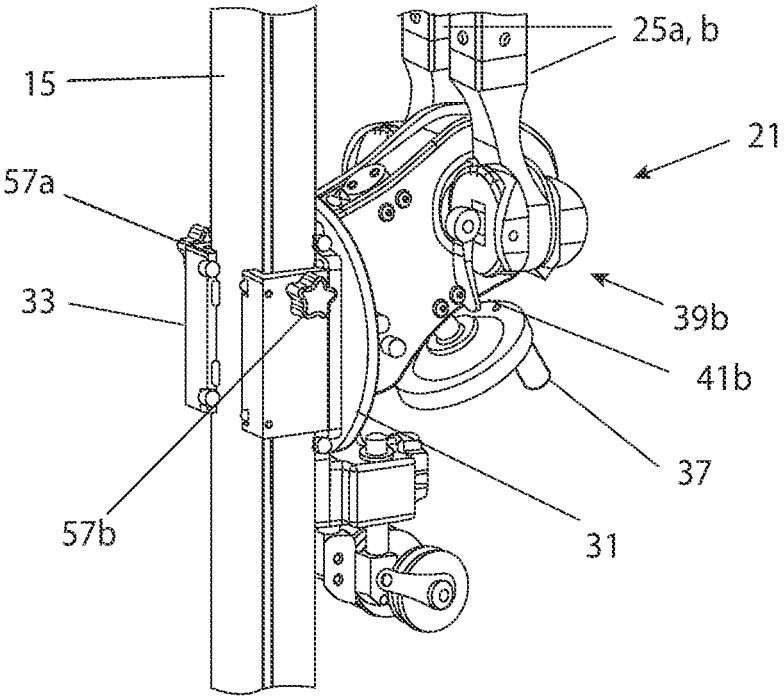
FIG. 3B is a rear perspective view of a central hub of a fitness system according to one embodiment of the present invention.

Referring to FIGS. 3A-B, there is seen a portion of the slidable unit 20 in a preferred embodiment. The slidable unit 20 comprises a mechanism 30 for sliding and securing the central hub 21 on the column 15 at any of a plurality positions, including positions at the top or bottom portions of the frame 50 such that arms or legs of a user can engage the arm/leg assemblies 99*a. b* with the arms at a plurality of different heights above the ground. The mechanism 30 for sliding and securing in the preferred embodiment shown in FIGS. 3A-B comprises a U-shaped plate 33 that fits around a complementary shaped portion of column 15 in a manner that permits sliding of U-shaped plate 33 along the column. The mechanism 30 further comprises one or more knobs 57*a, b* for securing the position of the slidable unit 20. Of course, the mechanism 30 could comprise any other component known in the art that can achieve the same purpose.

The central hub 21 is attached to a round plate 31 as shown in FIGS. 3A-B such as by bolting the round plate 31 to the central hub 21. The plate 31 has four outer holes that can be used to mount the central hub 21 to the plate 31. The plate 31 is mounted on U-shaped plate 33 such that, with U-shaped plate 33 slidably attached to the first column 15, the central hub 21 can be caused to slide along the first column 15 to any desired height above the ground. With the central hub 21 slid to a desired height, the central hub 21 can be secured in place along the column as discussed below with reference to FIGS. 5A-B. Sliding of the hub 21 allows the plurality of pulleys 73*a, b* attached to the bottom of the central hub 21 to be positioned at any desired height whereby to enable a user to perform pulley exercises while grasping the ends of a cable at the desired height simply by sliding the hub 21 along the column 15 until the desired height is reached and the hub is secured in place on the column.

Still referring to FIGS. 3A-B, the central hub 21 comprises a crank 37. Rotation of the crank 37 causes a worm gear (not shown) that is connected to the crank to turn a gear to which the pair of first arms 25*a, b* are attached, as described in U.S. Pat. No. 7,635,320 B2. This allows the pair of first arms 25*a-b* to rotate to any desired angular position. In one embodiment, the central hub 21 comprises mounts 39*a, b* for mounting the pair of arm assemblies on opposite sides of the central hub 21. The mounts 39*a, b* are connected to crank 37 which can cause the mounts 39*a, b* to pivot about a horizontal axis into various positions. Each of the mounts 39*a, b* comprises a mechanism for allowing pivoting, such as bars or hinges (not shown) that provide pivot points, that enables the first arm units to pivot about an axis perpendicular to the horizontal axis into various other positions so as to change an angle defined by the first arm units relative to the mounts 39*a, b*. The mounts 39*a, b* comprise fasteners 41*a, b* to secure the first arm units on the mounts 39*a, b* in the various positions and various other positions. The fasteners 41*a, b* are disposed at each of the joints where the pair of first arms 25*a, b* and the mounts 39*a, b* meet, and secure the angular position of the respective pair of first arms 25*a, b* against the respective mounts 39*a, b*. Of course, the depicted fasteners 41*a, b* can be replaced by any other component that is known in the art to achieve the same purpose.

Figure 4A:
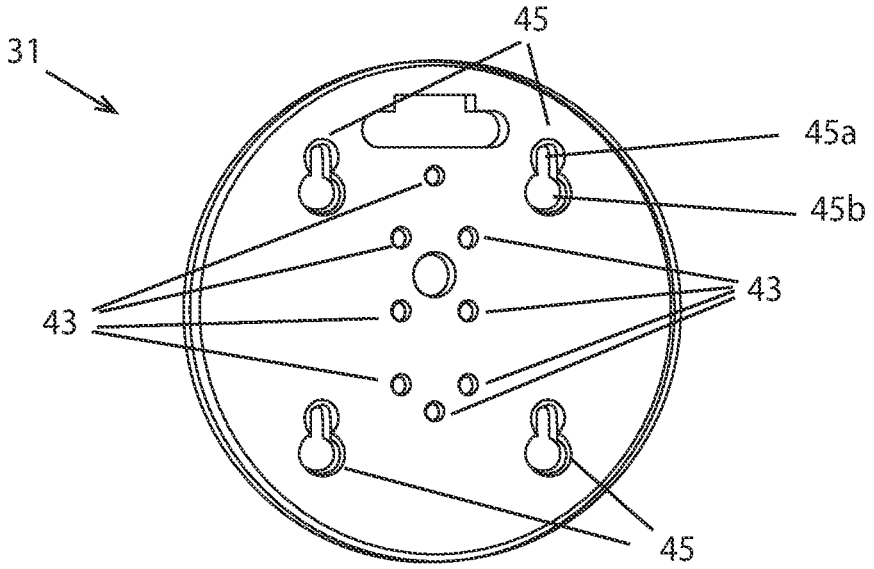
FIG. 4A is a front view of a round plate of a fitness system according to one embodiment of the present invention.
Figure 4B:
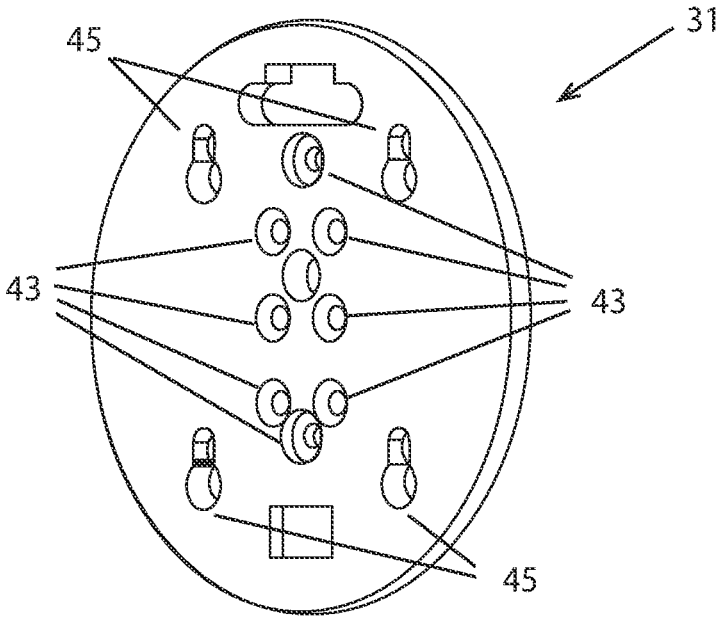
FIG. 4B is a rear view of a round plate of a fitness system according to one embodiment of the present invention.
Figure 4C:
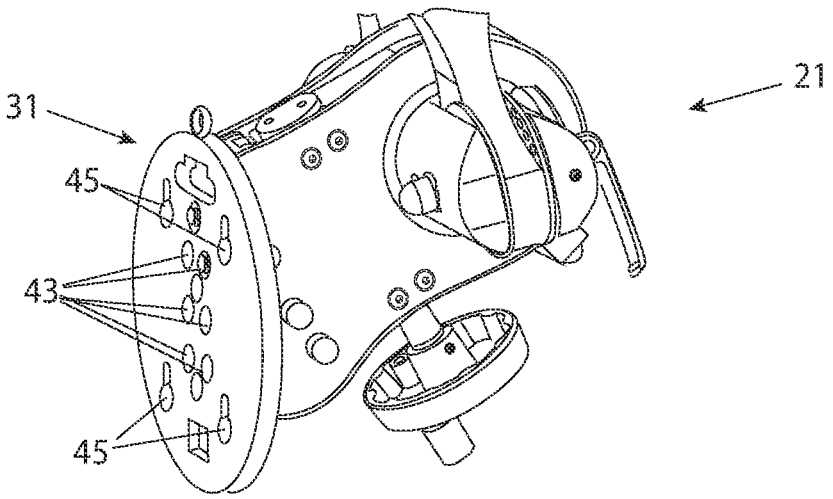
FIG. 4C is a rear perspective view of a round plate attached to a central hub according to one embodiment of the present invention.

FIGS. 4A-B show round plate 31 according to a preferred embodiment of the invention. The round plate 31 comprises a plurality of holes of different sizes and shapes as illustrated in the figures. As shown in FIG. 4C, holes 43 in the central portion of the plate 31 can be used to attach the round plate 31 to the central hub 21, while holes 45 near the periphery of the plate 31 can be used to attach the round plate 31 to a U-shaped plate 33. Each of holes 45 comprises a lower cavity and an upper cavity, wherein the size of the lower cavity 45*b* is larger than the size of the upper cavity 45*a* such that the head of a knob 66 attaching the round plate 31 to the U-shaped plate 33, as shown in FIG. 6A, passes the lower cavity and does not pass the upper cavity.

FIG. 4C shows a rear side of the round plate 31 attached to the central hub 21 with bolts disposed in the holes in the central portion of the plate 31. Other fastening mechanisms known in the art can also be used to firmly attach the round plate 31 to central hub 21.

Figure 5A:
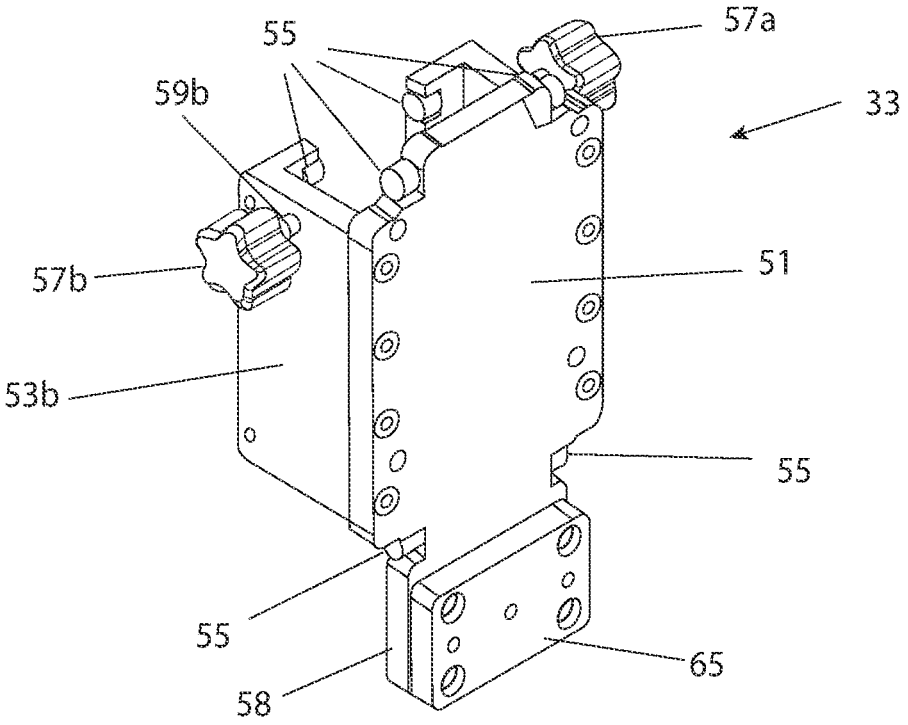
FIG. 5A is a front perspective view of a U-shaped plate of a fitness system according to one embodiment of the present invention.
Figure 5B:
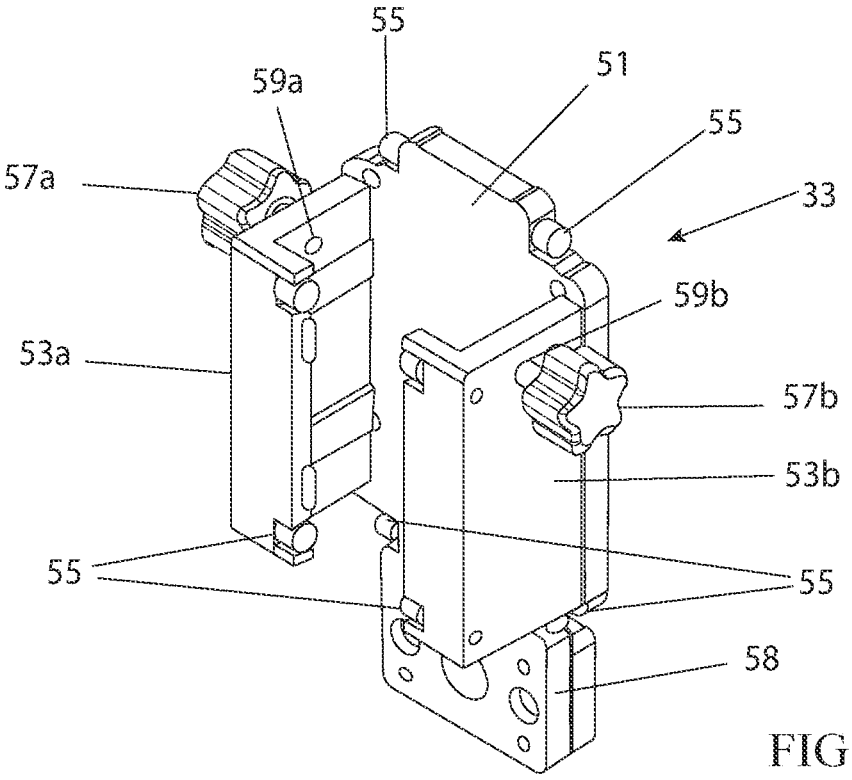
FIG. 5B is a rear perspective view of a U-shaped plate of a fitness system according to one embodiment of the present invention.
Figure 5C:
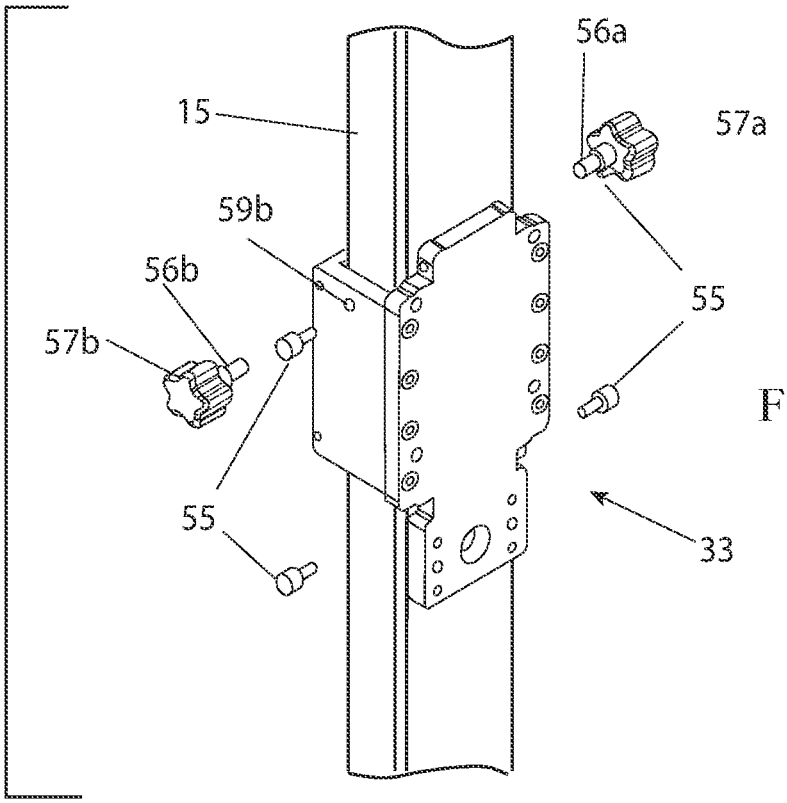
FIG. 5C is an exploded view of a U-shaped plate mounted on a first column of a fitness system according to one embodiment of the present invention.

FIGS. 5A-B show U-shaped plate 33 in a preferred embodiment. The U-shaped plate 33 has a front plate 51 and a pair of side plates 53*a, b*. In this embodiment, the U-shaped plate 33 has a lower portion 58, to which a pulley wheel housing (not shown) can be mounted. A plurality of wheels 55 are connected to the U-shaped plate 33. The wheels 55 are disposed on the U-shaped plate 33 such that when the U-shaped plate 33 is slidably attached to the first column 15, only the wheels 55 touch the first column 15. The U-shaped plate 33 and column 15 are sized so that the U-shaped plate does not contact the column 15 thus allowing the U-shaped plate 33 to smoothly slide along the first column 15. Side tightening knobs 57*a, b* comprising screws 56*a, b* are disposed on lateral sides of the U-shaped plate 33 with the screws 56*a, b* disposed in holes 59*a, b* on the sides of the U-shaped plate 33 (see FIG. 5C). Once the central hub 21 is at a desired height on the first column 15, the two knobs 57*a, b* can be turned to screw the screws 56*a, b* into contact with sides of the column 15 to secure the central hub 21 in desired position along the column 15. FIG. 5C shows an exemplary exploded view of the U-shaped plate 33 in position to be secured to the first column 15.

Figure 6A:
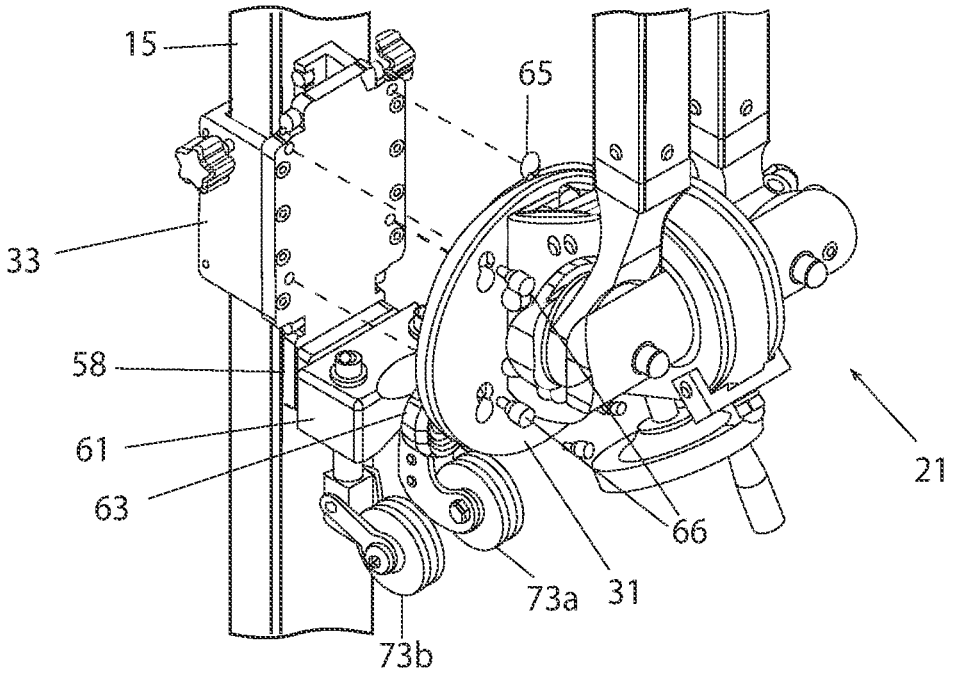
FIG. 6A is an exploded front perspective view of a central hub slidably attached to a column of a fitness system according to one embodiment of the present invention.
Figure 6B:
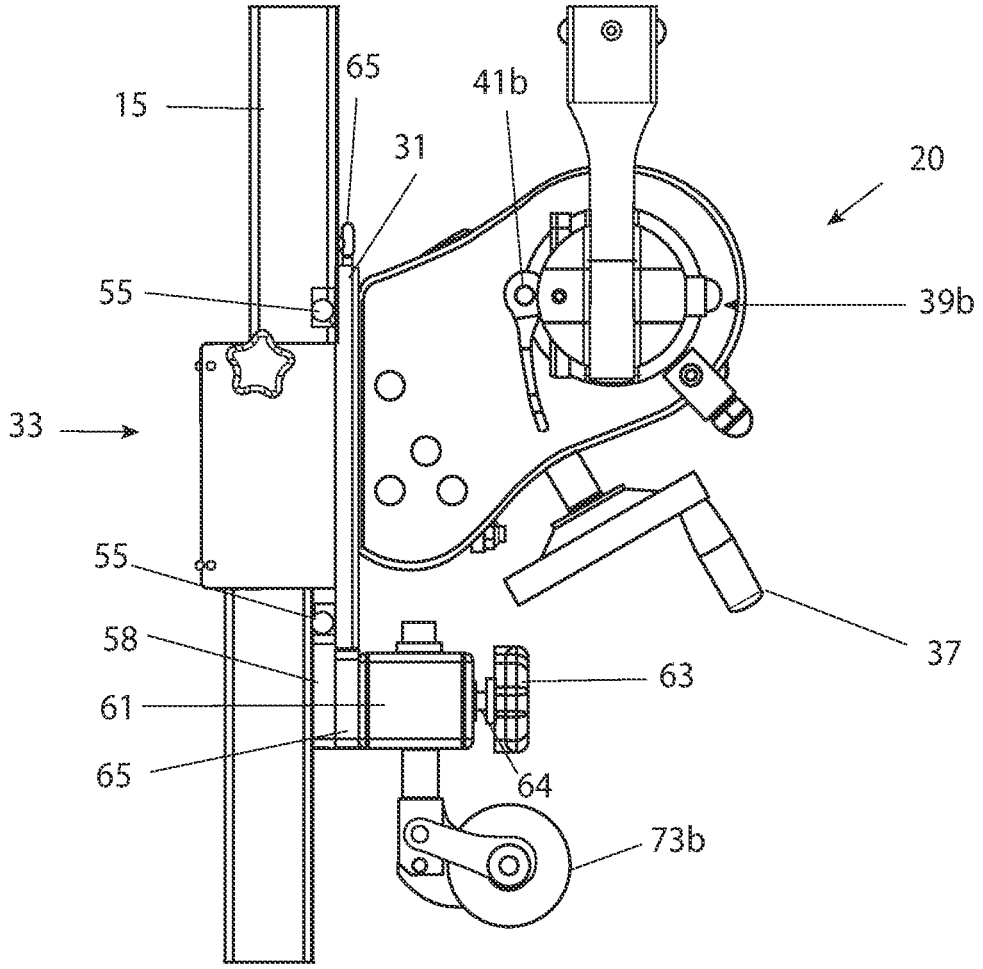
FIG. 6B is a side view of a central hub slidably attached to a column of a fitness system according to one embodiment of the present invention.

FIGS. 6A-B illustrate the round plate 31 together with the central hub 21 attached to the U-shaped plate 33 on the first column 15. In this embodiment, the round plate 31 is bolted to the U-shaped plate 33 through holes in the round plate 31 and in the U-shaped plate 33.

In FIGS. 6A-B, the central hub 21 is slidably attached to the first column 15. The first slidable unit 20 comprises pulley wheel housing 61 disposed on the lower portion 58 of the U-shaped plate 33. A pair of pulley wheels 73*a, b* are attached to the pulley wheel housing 61. A third knob 63 with screw 64 secures the central hub 21 with arms at a desired setting. The round plate 31 comprises eye bolt 65 for securing a cable 79 for pulling the first slidable unit 20 along the first column 15. (See FIGS. 7A-B.) The eye bolt 65 for securing the cable 79 can be replaced by any other component that achieves the same purpose. Preferably, the eye bolt 65 is attached to the top of the round plate 31, as shown in the figures. A pulley cable 79 connects the eye bolt 65 in the round plate 31, and can run up to the top of the first column 15 over the first vertical support 11 and down to the second slidable unit 22, such that the second slidable unit 22 counterweighs the first slidable unit 20 on the rear side of the fitness system 100. See also FIG. 7A.

Still referring to FIGS. 6A-B, the pulley wheel housing 61 is connected to a lower portion 58 of the U-shaped plate 33 by a small plate 65. Pulley cables 79 connect pulley handles 76*a, b*, 77*a, b* (FIGS. 7A-B) to the respective weights on third and fourth slidable units 24*a, b* through the second pulley assembly 73*a, b* mounted to the central hub 21, the first pulley assembly 75*a, b* on the bottom portion of the first column 15, and the third pulley assembly 71*a, b* on the top portion of the fitness system 100. See FIG. 7B.

Figure 8:
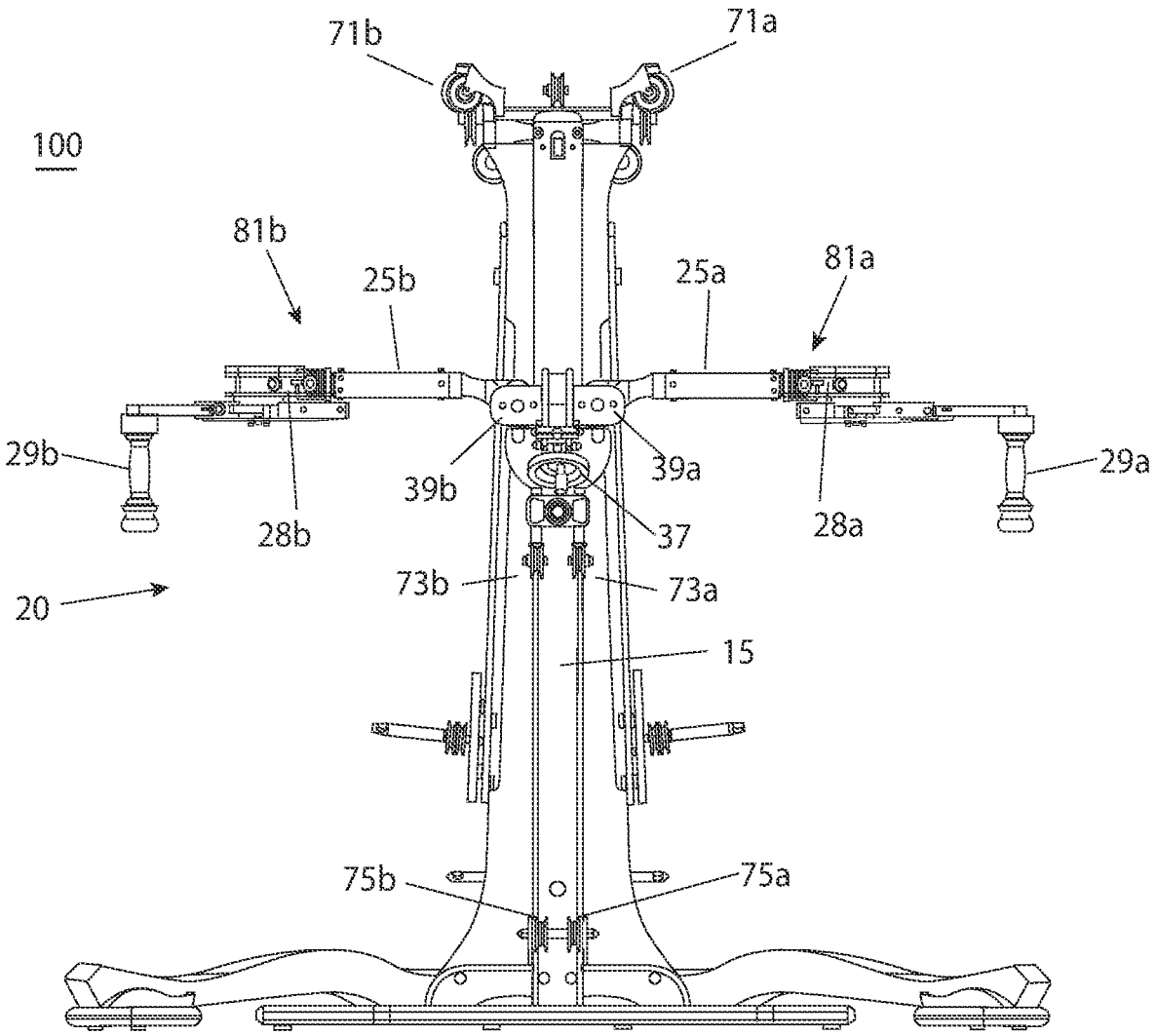
FIG. 8 is a front view of the fitness system of FIG. 2 with the arm assemblies in a second configuration.
Figure 9:
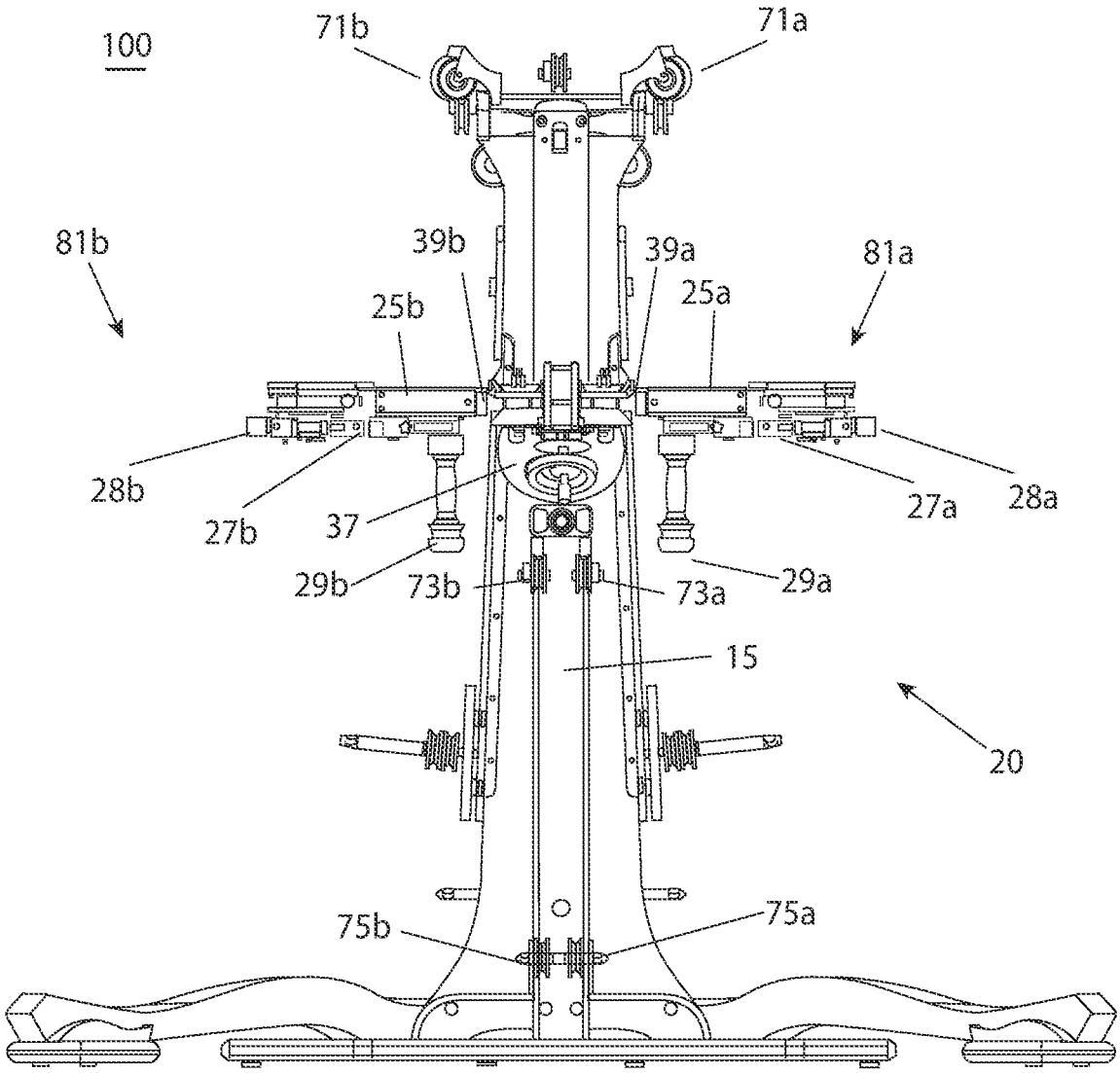
FIG. 9 is a front view of the fitness system of FIG. 2 with the arm assemblies in a third configuration.

FIGS. 8-11 illustrate the fitness system 100 with the arm assemblies disposed in each of a plurality of different exemplary configurations. In FIG. 8, the arm assemblies are disposed with arm units 81*a, b* aligned and extending outward and with handles 29*a, b* projecting downward. In FIG. 9, the arm assemblies are disposed with arm units 81*a, b* aligned, pair of first arms 25*a, b* extending outward, pair of second arms 27*a, b* rotated inward, and with handles 29*a, b* projecting downward.

Figure 10:
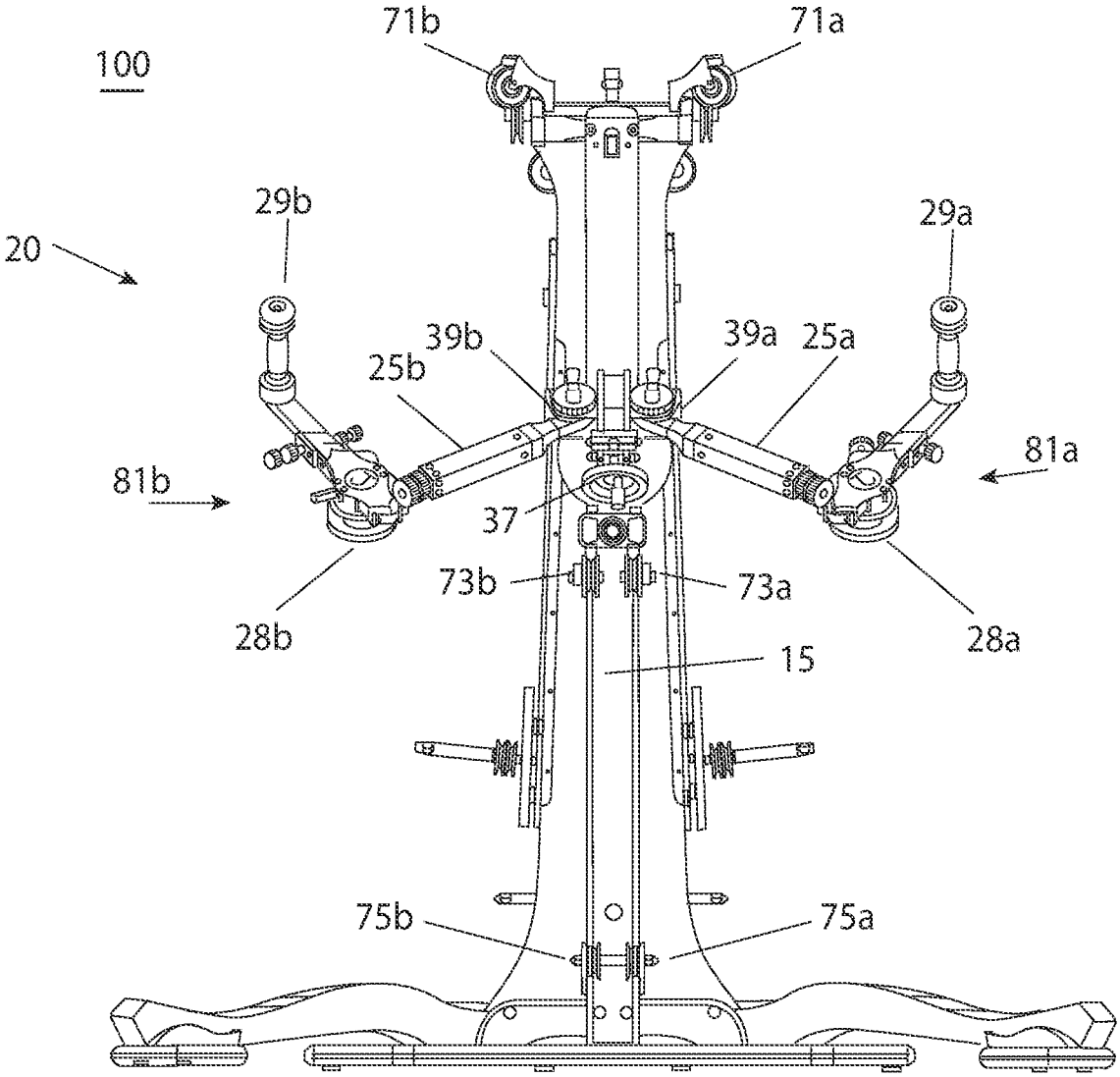
FIG. 10 is a front view of the fitness system of FIG. 2 with the arm assemblies in a fourth configuration.

In FIG. 10, the arm assemblies are disposed with arm units 81*a, b* arranged to form a "W" shape and with handles 29*a, b* projecting diagonally upward.

Figure 11:
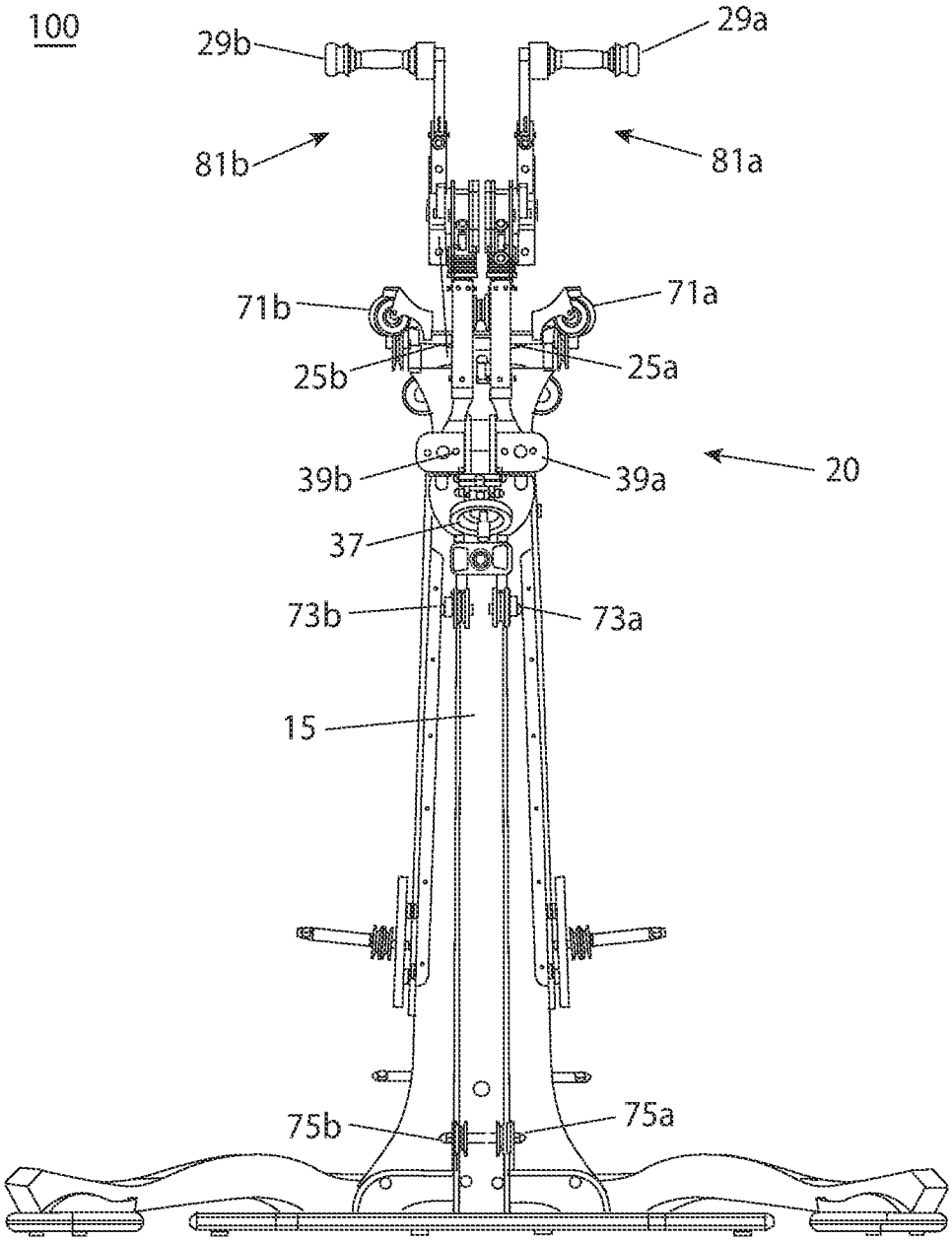
FIG. 11 is a front view of the fitness system of FIG. 2 with the arm assemblies in a fifth configuration.

In FIG. 11, the arm assemblies are disposed with arm units 81*a, b* aligned parallel to a first column 15 and positioned at a top portion of the first column 15 with handles 29*a, b* projecting laterally. The height of the first slidable unit 20 can be adjusted to a desired height by sliding the first slidable unit 20 upward or downward along the first column 15 and securing the position of the first slidable unit 20 in the manner described above with reference to FIGS. 5A-C. The angular position of the pair of first arms 25*a, b* can be adjusted by loosening the mount 39*a, b*, adjusting the angles of a desired arm of the pair of first arms 25*a, b*, adjusting the angular position of the pair of first arms 25*a, b*, and securing the arm assemblies in the desired configuration as described above with reference to FIGS. 3A-B. The crank 37 can rotate the pair of first arms 25*a-b* to any desired angular position, as described above with reference to FIGS. 3A-B.

Figure 12:
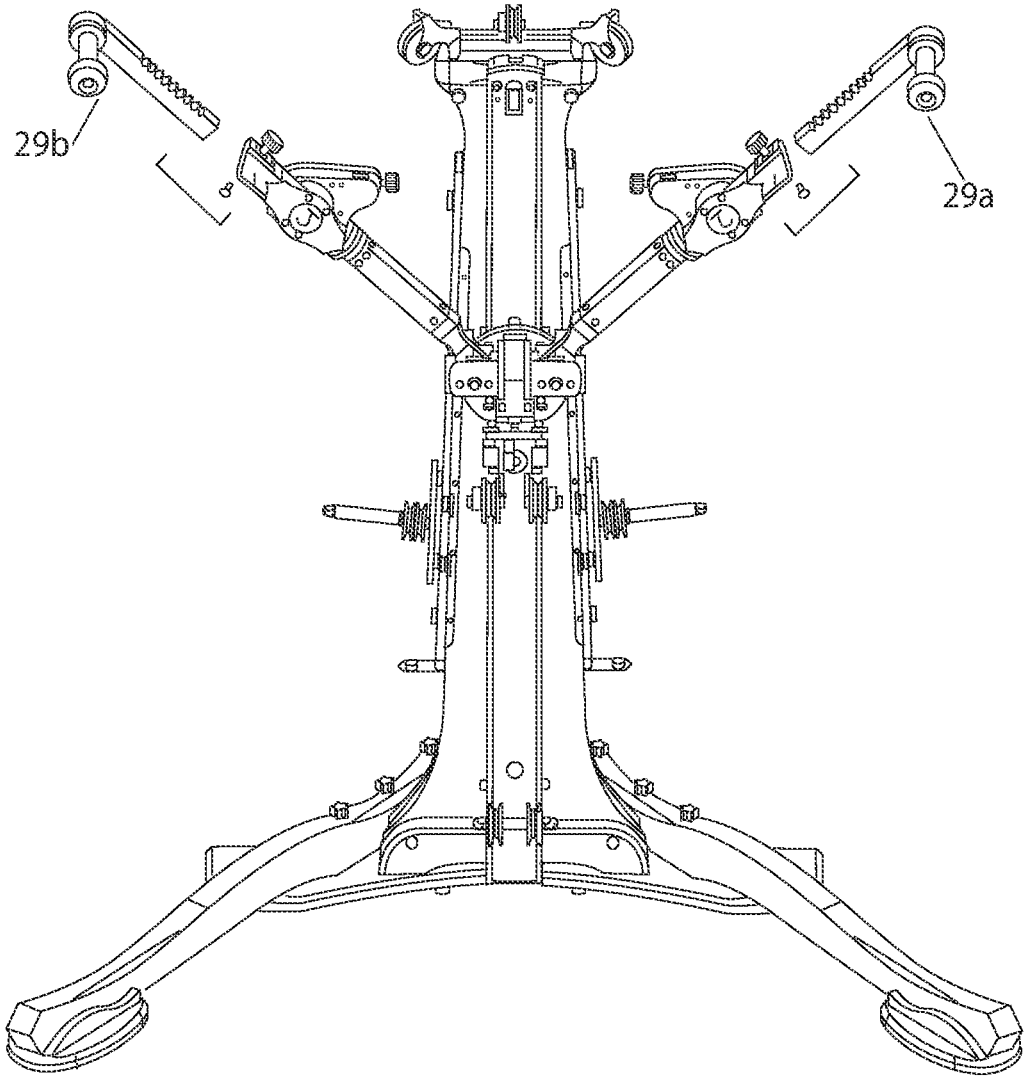
FIG. 12 is a perspective view of the fitness system of FIG. 2 with detachable handles.
Figure 13:
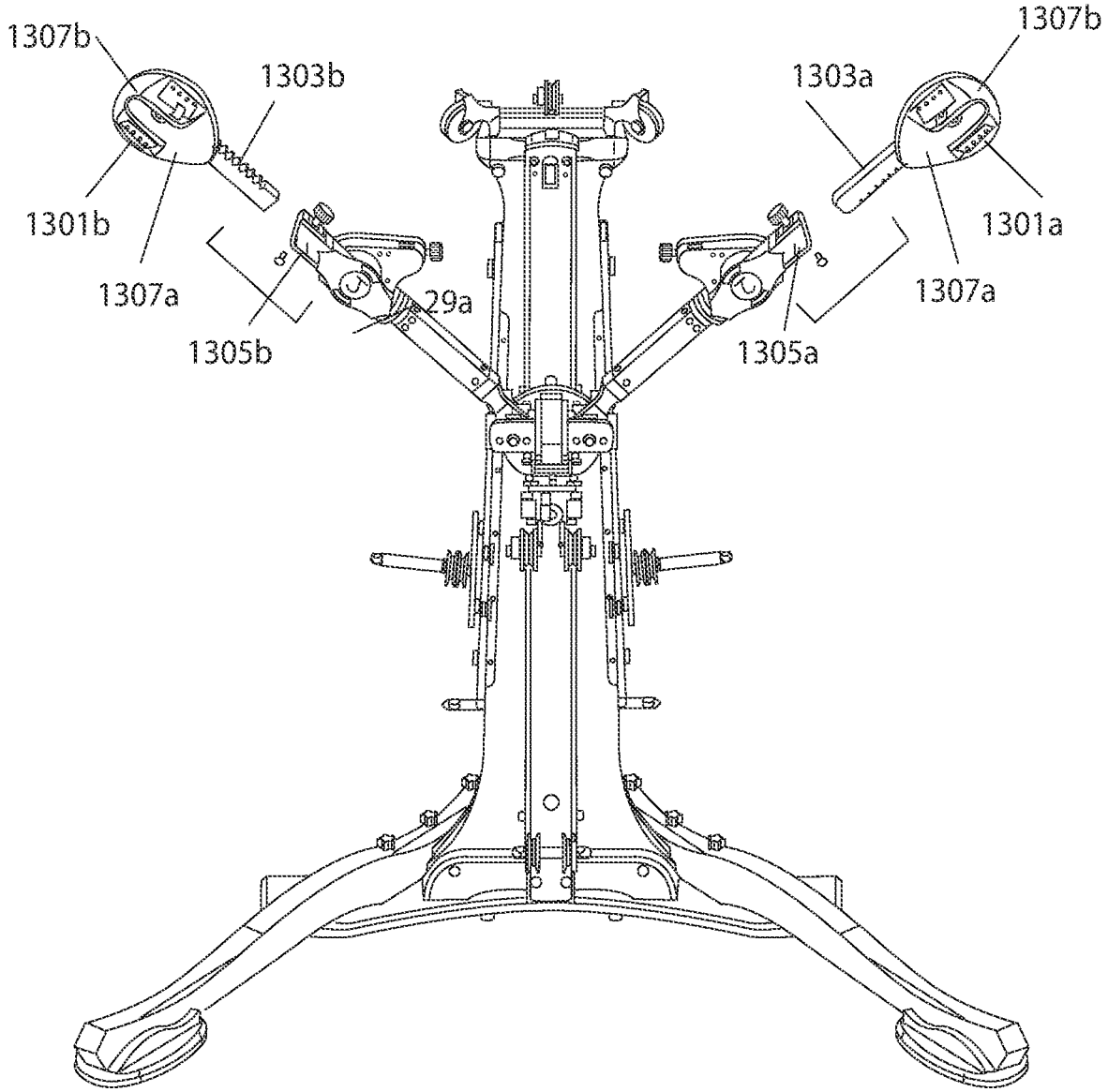
FIG. 13 is a perspective view of the fitness system of FIG. 2 with foot attachments for accommodating the feet of a user.

In a preferred embodiment, each of the handles 29*a, b* of the respective second arm units is detachable (see FIG. 12) and replaceable by foot attachments. As shown in FIG. 13, each of the plurality of foot attachments 1301*a, b* is attachable to the arm/leg assemblies when the respective handles 29*a, b* are detached therefrom. The foot attachments comprise upper and lower portions 1307*a* and 1307*b* for receiving and securing a foot of a user of the exercise apparatus whereby the plurality of foot attachments 1301*a, b* can facilitate exercises involving engagement of the legs of the user with the arm/leg assemblies. The mechanisms for detaching the handles 29*a, b* from the arm/leg assemblies and attaching the foot attachments in their place are explained next.

Figure 14:
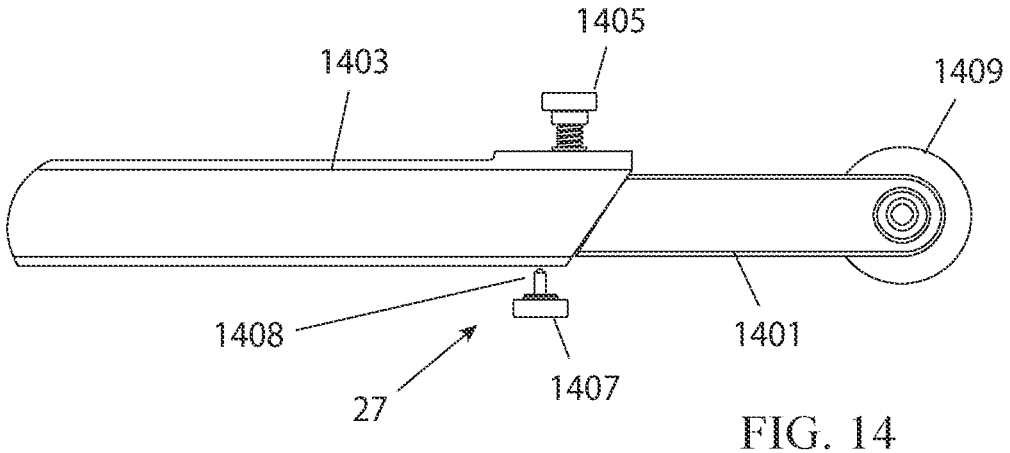
FIG. 14 illustrates an elongate second arm comprising a mechanism for detaching the handles.

Referring to FIG. 14, there is seen a portion of an elongate second arm 27 of a second arm unit discussed with reference to FIG. 2, for example. In a preferred embodiment, the elongate second arm 27 comprises a bar 1401, a tube 1403, a top knob 1405, and a bottom knob 1407. A first end of the bar 1401 can be inserted into a hollow portion of the tube 1403 and can slide along the hollow portion of the tube 1403. The bar 1401 comprises a handle 1409 protruding from a second end of the bar 1401. The bar of the handle 1401 can be replaced with a bar 1303*a, b* of the foot attachment 1301*a, b* (see also FIG. 13).

Still referring to FIG. 14, the top knob 1405 is used for securing the bars of the handles 1401 in place at a desired length, whereby to allow a user to adjust the size of the circle when a user grasps the handles 29*a, b* and performs exercises by making circular arm movements. The bottom knob 1407 can be tightened into a groove 1503 on a side of the handle bar piece 1401 to act as a stopper (see also FIGS. 15B and 16). The tip of the bolt 1408 on the bottom knob 1407 can be used to keep the bar 1401 from sliding out of the tube 1403. The bottom knob 1407 can be loosened and tightened when replacing the bars of the handles 1401 with the bars of the foot attachments 1303*a, b* and vice versa. In other words, once the bottom knob 1408 is tightened, the user does not need to touch it again when performing circular exercises. The top knob 1405 can be used for adjusting the length of the bar of the handle 1401 to adjust the circumference of the circle. The top knob 1405 can be at least slightly loosened when replacing the bar of a handle with the bar of a foot attachment. The top knob 1405 can be spring-biased toward the bar of the handle 1401 such that the top knob 1405 can pop into one of a plurality of holes shown in FIG. 15A when the user is adjusting the length of the bar 1401. One of skill in the art will appreciate that the bars of the foot attachments 1303*a, b* can be adjusted on and detached from the arm/leg assemblies in the same manner as with the bars of the handles.

Figure 15A:
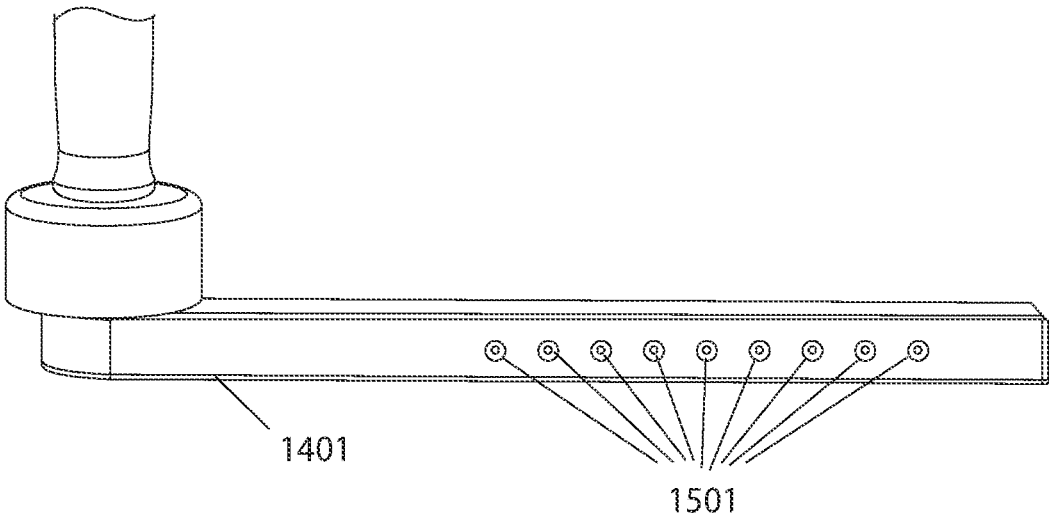
FIG. 15A shows a first side of a bar for a handle.
Figure 15B:
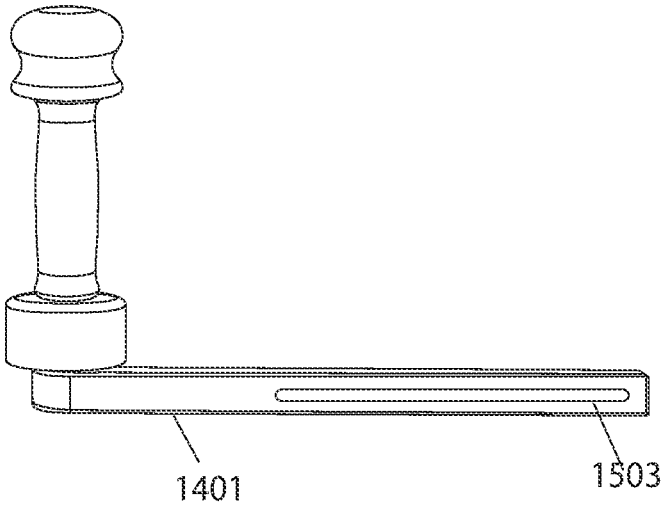
FIG. 15 B shows a second side of a bar for a handle.

FIGS. 15A-15B show first and second sides of the bar of the handle 1401, respectively, in a preferred embodiment. The first side of the bar of the handle 1401 comprises a plurality of holes 1501, which the top knob 1405 can be inserted into or removed from, to adjust and secure the length of the second arm unit. The second side of the bar of the handle 1401 comprises a groove 1503 into which the bottom knob 1407 can be tightened and within which the bottom knob can slide until it meets an end of the groove 1503.

Figure 16:
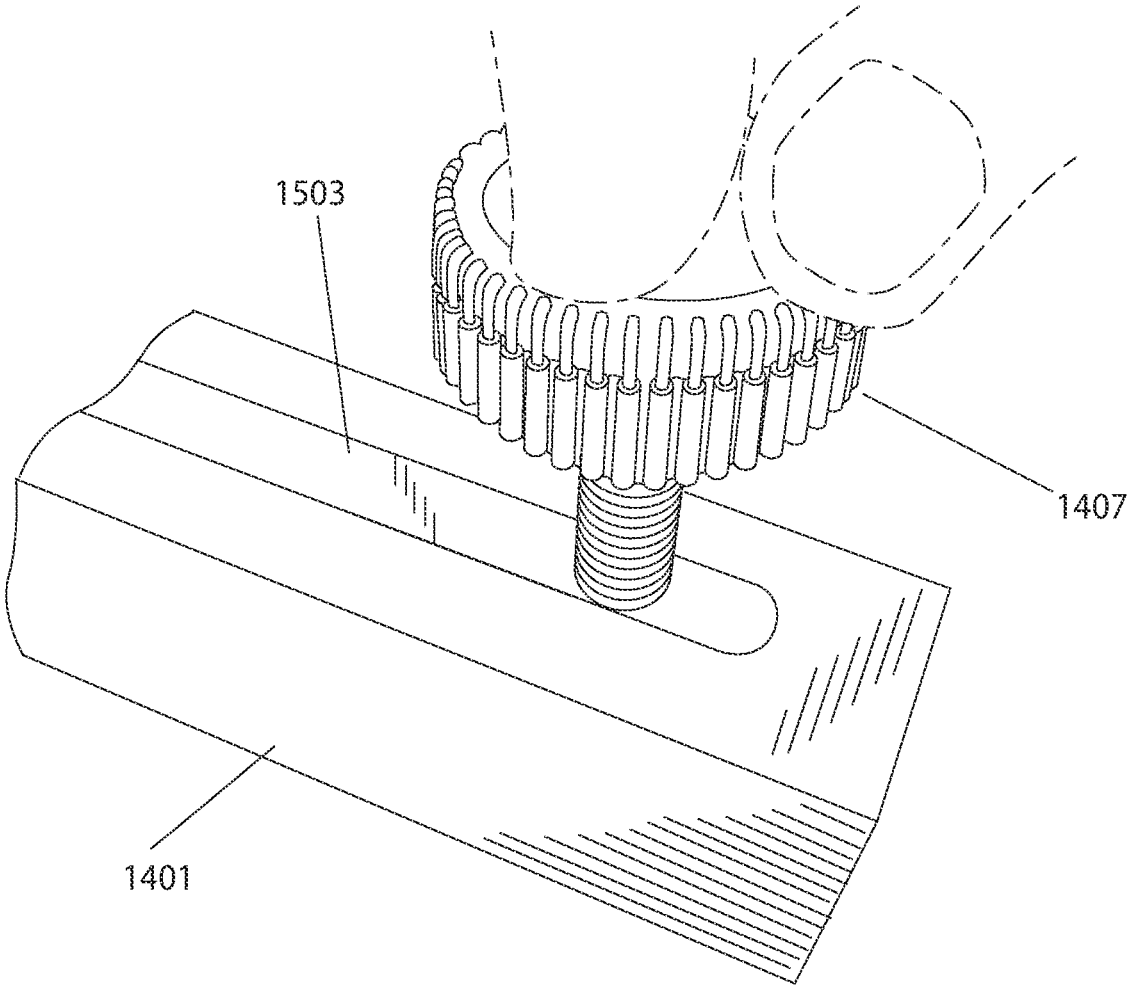
FIG. 16 is a close-up view of a portion of a second side of a bar for a handle

Referring to FIG. 16, there is seen the bottom knob 1407 disposed near the end of the groove 1503 of the second side of the bar 1401 with the tube 1403 removed for the purpose of illustrating the stopping mechanism.

Figure 17:
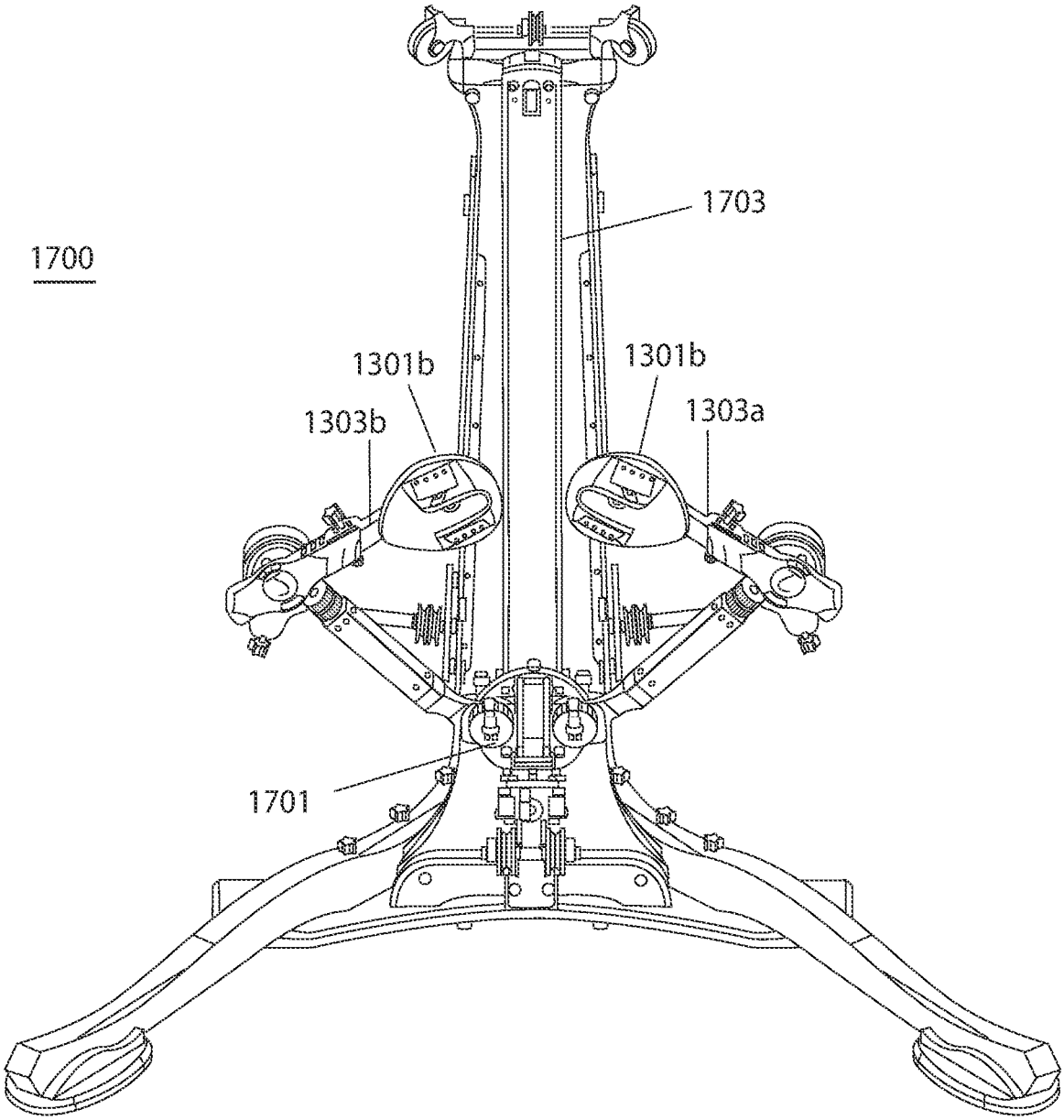
FIG. 17 is a perspective view of the fitness system with foot attachments.

FIG. 17 illustrates the fitness system 1700 with the central hub 1701 pulled down the column 1703 and with the bars of the foot attachments 1303*a, b* slid into tubes 1403. In this configuration, the user lying on a bench (not shown) can secure his or her feet in the foot attachments 1301*a, b* and exercise his or her legs.

Figure 18:
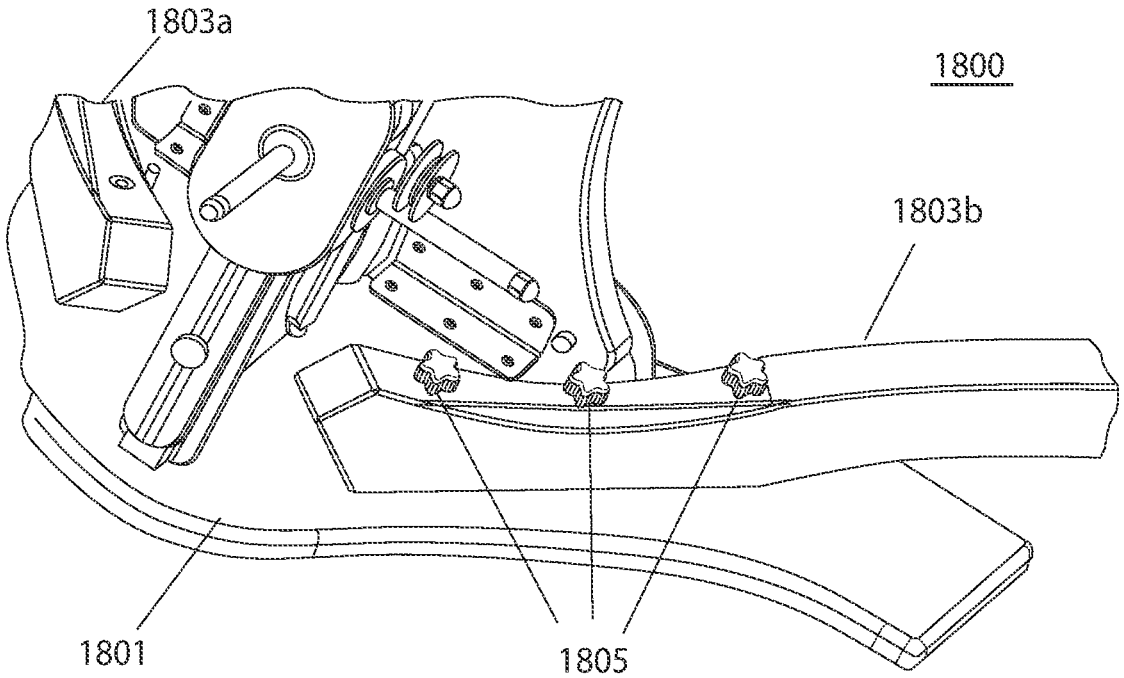
FIG. 18 shows an adjustable base of the fitness system.

Referring to FIG. 18, there is seen a bottom portion of the fitness system 1800 in a preferred embodiment wherein the fitness system 1800 stands on a base 1801 that can be modified depending on the space available in the room, studio or gym in which the fitness system is disposed. In FIG. 18, the base 1801 is disposed on the ground with the legs 1803*a, b* detachably attached as part of the base to provide additional stability to the unit when space permits. The legs 1803*a, b* are attached to the base 1801 with a plurality of knobs 1805 or any other means known in the art that permit detachment of the legs 1803*a, b* from the remainder of the base. The base 1801 is configured to support the fitness system 1800 even without the legs 1803*a, b*. The legs 1803*a, b* simply make the system additionally resistant to external forces when space permits. Because the legs 1803*a, b* can be readily attached to or detached from the base 1801, a user can remove the legs 1803*a, b* to provide more room for a user to exercise with the fitness system 1800 or to perform other exercises when space is tight.

Figure 19A:
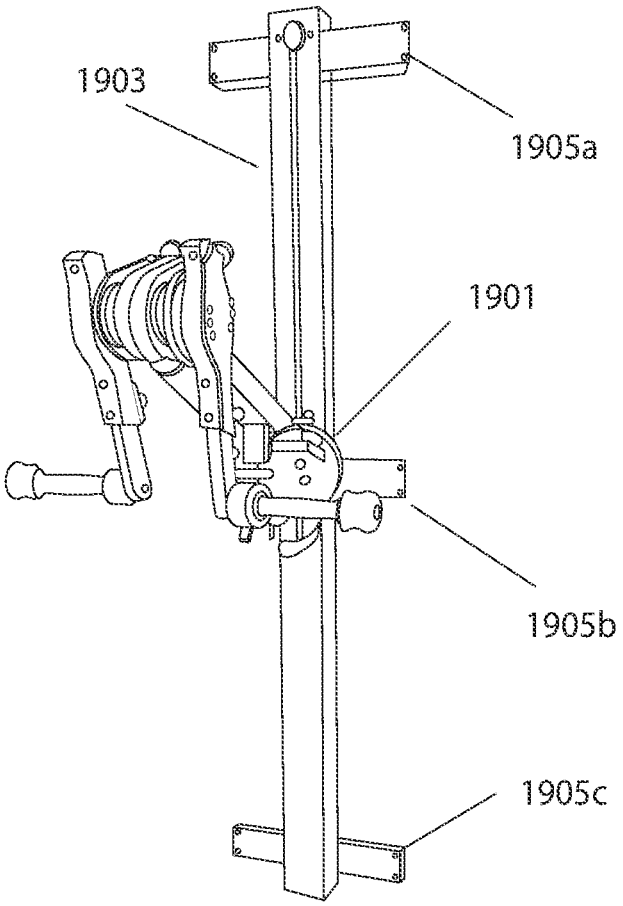
FIG. 19A illustrates a central hub slidably attached to a wall mount track.
Figure 19B:
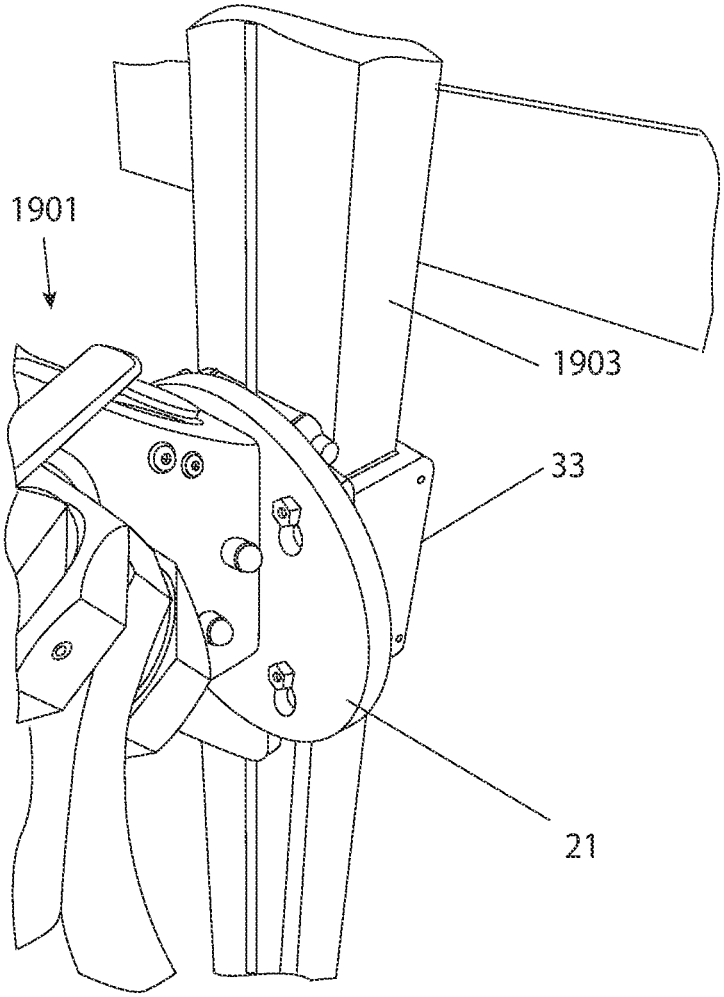
FIG. 19B is a close-up view of a portion of a central hub attached to a wall mount track.

Although the slidable central hub 21 has been described above for use with the vertical column 15 of fitness system 100, 1700, 1800, the round plate 31 can be detached from column 15 by lifting up the central hub 21 until the heads of the knobs 66 are disposed at the lower cavities 45*b* of the round plate 31. This allows the central hub 21 to be pulled out, and the round plate 31 can then be used to attach the slidable hub 21 to a different vertical column. Referring to FIGS. 19A-19B, there is seen the central hub 21 detached from the vertical column 21 and slidably attached to another vertical column, i.e. track 1903 which is shown mounted on a wall although it could be mounted on any other vertical surface. The central hub 1901 in this embodiment is also attached to a U-shaped plate 33 through a round plate 31 in a configuration that is identical to the configuration of the central hub 21 discussed with reference to FIGS. 1A-6B. A plurality of plates 1905*a-c* are attached to the wall. The wall mount track 1903 is attached to the plurality of plates 1905*a-c* in such a way that there is a sufficient gap between the wall mount track 1903 and the wall so that the U-shaped plate 33 can slide up and down along the wall mount track 1903 without contacting the wall. The central hub 21 can be detached from the wall mount track 1903 and then mounted to the first column 15 discussed with reference to FIGS. 1A-3B, or vice versa.

While various embodiments of the present invention have been described above, it should be understood that they have been presented by way of example, and not limitation. It will be apparent to persons skilled in the relevant art(s) that various changes in form and detail can be made therein without departing from the spirit and scope of the present invention. Thus, the present invention should not be limited by any of the above-described exemplary embodiments but should be defined only in accordance with the following claims and their equivalents.

In addition, it should be understood that the figures illustrated in the drawings, which highlight the functionality and advantages of the present invention, are presented for purposes of example only. The architecture of the present invention is sufficiently flexible and configurable, such that it may be utilized (and navigated) in ways other than that shown in the accompanying figures.

Moreover, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the present invention in any way. It is also to be understood that the steps and processes recited in the claims need not be performed in the order presented.

What is claimed is:

1. An exercise apparatus, comprising:

(1) a frame for supporting the exercise apparatus, the frame comprising a bottom portion and a top portion;

(2) an elongate column mounted on the frame such that, with the frame disposed on a ground surface, the elongate column extends in a vertical direction from the bottom portion of the frame to the top portion of the frame;

(3) a pair of arm/leg assemblies; and (4) a slidable unit comprising a central hub, means for sliding and securing the central hub along the elongate column at any of a plurality of positions, including a position at the top portion of the frame and a position at the bottom portion of the frame, and means for mounting the pair of arm/leg assemblies on opposite sides of the central hub such that, with the frame disposed on the ground surface, the pair of arm/leg assemblies can be disposed at a plurality of different heights above the ground surface by sliding the central hub along the elongate column;

wherein each of the pair of arm/leg assemblies comprises: (i) a first arm unit comprising an elongate first arm having a first end and a second end; (ii) a second arm unit comprising an elongate second arm having a first end and a second end and a handle protruding from the second end of the elongate second arm; and (iii) a mounting unit that rotatably mounts the first end of the elongate second arm to the second end of the elongate first arm such that the second arm unit can be fixedly disposed relative to the first arm unit in any of a plurality of configurations and, with use of the handle, can be rotated 360 degrees with respect to the first arm unit in any of a plurality of planes, including a first plane that is transverse to the vertical direction and a second plane that is parallel to the vertical direction.

2. The exercise apparatus according to claim 1, wherein the means for mounting enables each of the pair of arm/leg assemblies to be (i) selectively pivotable about a horizontal axis into various positions and selectively pivotable about an axis perpendicular to the horizontal axis into various other positions so as to enable a change of an angle defined by the first arm units relative to each other and (ii) securable in the various positions and the various other positions.

3. The exercise apparatus according to claim 1, comprising a resistance assembly, a plurality of pulley assemblies, at least one cable for coupling the plurality of pulley assemblies to the resistance assembly and gripping means at an end of the at least one cable for enabling a user to grip the at least one cable, the plurality of pulley assemblies comprising a first pulley assembly and a second pulley assembly disposed on a bottom of the elongate column and a bottom of the central hub respectively such that the first pulley assembly can guide the at least one cable to the second pulley assembly such that, by sliding the central hub along the elongate column, the second pulley assembly guides the at least one cable to positions at any of the plurality of different heights above the ground surface whereby the user can engage in resistance exercises at any of the plurality of different heights with use of the gripping means at the end of the at least one cable.

4. The exercise apparatus according to claim 3, wherein the plurality of pulley assemblies further comprises a third pulley assembly disposed on the top portion of the frame.

5. The exercise apparatus according to claim 3, further comprising means for counterbalancing the slidable unit, wherein the means for counterbalancing is disposed on an opposite side of the frame from the slidable unit.

6. The exercise apparatus according to claim 5, wherein the counterbalancing means comprises a second slidable unit that is slidable along a second elongate column disposed on the opposite side of the frame, wherein the at least one cable connects the slidable unit comprising the central hub with the second slidable unit.

7. The exercise apparatus according to claim 1, wherein each of the handles of the pair of arm/leg assemblies comprises means for detaching and re-attaching the handles from the elongate second arms, and wherein the exercise apparatus further comprises a plurality of foot attachments with the plurality of foot attachments comprising means for attaching and detaching the plurality of foot attachments to respective of the elongate second arms of the arm/leg assemblies when the handles are detached from the elongate second arms.

8. The exercise apparatus according to claim 7, wherein each of the elongate second arms comprises a hollow tubular member and each of the means for detaching and re-attaching the handles and each of the means for attaching and detaching the plurality of foot attachments comprises a bar configured to slide into and out of the hollow tubular member.

9. The exercise apparatus according to claim 1, wherein the means for sliding and securing the central hub along the elongate column comprises a round plate and a U-shaped plate, wherein the central hub is coupled to a front side of the round plate, and wherein the U-shaped plate is coupled to a rear side of the round plate.

10. The exercise apparatus according to claim 9, wherein the means for sliding and securing comprises a knob on the U-shaped plate.

11. The exercise apparatus according to claim 1, wherein the exercise apparatus is a standalone structure without an integrated bench.

12. The exercise apparatus according to claim 1, wherein the exercise apparatus further comprises:

a base that is disposed below the frame and supports the exercise apparatus, a plurality of legs, and securing means for attaching the plurality of legs;

wherein the plurality of legs are detachably attached onto the base with the securing means and wherein the base stably supports the exercise apparatus both with the plurality of legs attached to the base and with the plurality of legs detached from the base.

13. The exercise apparatus according to claim 1, wherein the central hub is detachably mounted to the elongate column.

14. The exercise apparatus according to claim 1, further comprising a second elongate column that is attachable to a vertical wall or other vertically oriented surface, wherein the slidable unit is detachable from the elongate column and mountable on the second elongate column with the central hub slidable and securable along the second elongate column at any of a plurality of positions whereby a user can attach the sliding unit to either the elongate column or the second elongate column to perform exercises with the sliding unit on either the elongate column or the second elongate column.

15. A slidable unit for sliding on a vertical column, the slidable unit comprising:

(a) a central hub;

(b) a pair of arm/leg assemblies, each of the pair of arm/leg assemblies comprising (i) a first arm unit comprising an elongate first arm having a first end and a second end; (ii) a second arm unit comprising an elongate second arm; and (iii) a mounting unit that rotatably mounts the first end of the elongate second arm to the second end of the elongate first arm such that the second arm unit can be fixedly disposed relative to the first arm unit and rotated 360 degrees with respect to the first arm unit in any of a plurality of planes, including a first plane that is transverse to a vertical direction of the vertical column and a second plane that is parallel to the vertical direction;

(c) means for mounting the pair of arm/leg assemblies on opposite sides of the central hub such that they are (i) selectively pivotable about a horizontal axis into various positions and selectively pivotable about an axis perpendicular to the horizontal axis into various other positions so as to enable a change of an angle defined by the first arm units relative to each other and (ii) securable in the various positions and the various other positions;

(d) means for sliding the central hub along the vertical column to any of a plurality of positions:

(e) means for securing the central hub to the vertical column at any of the plurality of positions; and (f) a pulley assembly disposed on a bottom of the central hub such that the pulley assembly can guide a cable coupled to a resistance assembly to positions at any of a plurality of heights above a ground surface when the central hub is slid and secured along the vertical column at any of the plurality of heights.

16. The slidable unit according to claim 15, wherein the means for sliding the central hub along the vertical column comprises a U-shaped plate that is slidably attachable to the vertical column and a round plate comprising a plurality of holes, wherein the central hub is mounted to a front side of the round plate, and the U-shaped plate is mounted to a rear side of the round plate, and wherein the round plate comprises means for securing the cable for pulling the slidable unit along the vertical column.

17. The slidable unit according to claim 15, wherein each of the pair of arm/leg assemblies further comprises: a handle protruding from the second end of the elongate second arm and wherein each of the handles of the pair of arm/leg assemblies comprises means for detaching and re-attaching the handles from the elongate second arms.

18. An apparatus comprising the slidable unit according to claim 15 and a plurality of foot attachments, the plurality of foot attachments comprising means for attaching the foot attachments to the elongate second arms, respectively, of the pair of arm/leg assemblies when handles are detached from the elongate second arms.

19. An apparatus comprising the slidable unit according to claim 15 and a column that is mountable on a wall in a vertical disposition with respect to the ground surface.

* * * * *